US010160199B2

(12) United States Patent
Date

(10) Patent No.: US 10,160,199 B2
(45) Date of Patent: Dec. 25, 2018

(54) LIQUID DISCHARGING APPARATUS AND LIQUID DISCHARGING MODULE

(71) Applicant: Seiko Epson Corporation, Tokyo (JP)

(72) Inventor: Kyohei Date, Nagano (JP)

(73) Assignee: Seiko Epson Corporation (JP)

( * ) Notice: Subject to any disclaimer, the term of this patent is extended or adjusted under 35 U.S.C. 154(b) by 59 days.

(21) Appl. No.: 14/957,991

(22) Filed: Dec. 3, 2015

(65) Prior Publication Data

US 2016/0167382 A1 Jun. 16, 2016

(30) Foreign Application Priority Data

Dec. 11, 2014 (JP) ..... 2014-250672

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04588* (2013.01); *B41J 2/04593* (2013.01); *B41J 2/04596* (2013.01); *B41J 2/14233* (2013.01); *B41J 2002/14362* (2013.01); *B41J 2002/14491* (2013.01); *B41J 2202/20* (2013.01)

(58) Field of Classification Search
CPC ..... B41J 2/04541; B41J 2/04596; B41J 2/04581; B41J 2/04588; B41J 2/04593; B41J 2/14233; B41J 2002/14362; B41J 2002/14491; B41J 2202/20
See application file for complete search history.

(56) References Cited

U.S. PATENT DOCUMENTS 8,899,727 B2 * 12/2014 Owaki ..... B41J 2/125 347/19
9,186,897 B2 * 11/2015 Yamamoto ..... B41J 2/14072
2004/0109041 A1 * 6/2004 Owaki ..... B41J 2/14274 347/20
2004/0228102 A1 11/2004 Sugawara et al.
2006/0214997 A1 * 9/2006 Chikamoto ..... B41J 2/14209 347/71
2011/0279549 A1 11/2011 Miyazaki et al.
2015/0328883 A1 * 11/2015 Iijima ..... B41J 2/14233 347/9

FOREIGN PATENT DOCUMENTS

JP 2004-363581 A 12/2004
JP 2011-240519 A 12/2011
JP 5354801 B2 11/2013
JP 2015217598 A * 12/2015 ..... B41J 2/14233

* cited by examiner

*Primary Examiner* — Julian Huffman
*Assistant Examiner* — Michael Konczal
(74) *Attorney, Agent, or Firm* — Harness, Dickey & Pierce, P.L.C.

(57) ABSTRACT

There is provided a liquid discharging apparatus including: a discharging portion which discharges liquid; a fixing portion which fixes the discharging portion; a circuit substrate for controlling discharge of the liquid; a head cover which covers the circuit substrate; and a covering portion which connects the fixing portion and the head cover to each other, and covers a part between the fixing portion and the head cover.

17 Claims, 21 Drawing Sheets

<DECODING CONTENTS OF DECODER>

| PRINTING DATA SI | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

LIQUID DISCHARGING APPARATUS AND LIQUID DISCHARGING MODULE

The entire disclosure of Japanese Patent Application No. 2014-250672, filed Dec. 11, 2014 is expressly incorporated by reference herein.

BACKGROUND

1. Technical Field

The present invention relates to a liquid discharging apparatus and a liquid discharging module.

2. Related Art

A printing apparatus which prints an image or a document as a discharging portion discharges liquid, such as ink, is known. In general, the discharging portion includes a piezoelectric element, such as a piezo element, and discharges a predetermined amount of ink at a predetermined timing from a nozzle as each of the piezoelectric elements are driven in accordance with the driving signal.

As a technology employed in such a printing apparatus, for example, a technology which supplies a discharge control signal that controls a discharging operation by a discharging portion, and a driving signal which drives (the piezoelectric elements of) the discharging portions by a liquid discharging head unit that is an aggregate of the discharging portions (refer to Japanese Patent No. 5354801).

In such a printing apparatus, it is required to perform printing at a high speed. In increasing the speed of printing, it is necessary to transfer the discharge control signal and the driving signal to the discharging portion at a higher frequency.

Here, when transferring the signals having a high frequency to the discharging portion, the discharging portion or the like radiates electromagnetic wave noise which becomes a source of noise.

SUMMARY

An advantage of some aspects of the invention is to provide a liquid discharging apparatus and a liquid discharging module in which radiation of electromagnetic wave noise is reduced.

According to an aspect of the invention, there is provided a liquid discharging apparatus including: a discharging portion which discharges liquid; a fixing portion which fixes the discharging portion; a circuit substrate for controlling discharge of the liquid; a head cover which covers the circuit substrate; and a covering portion which connects the fixing portion and the head cover to each other, and covers a part between the fixing portion and the head cover.

In this case, the fixing portion and the head cover are connected to each other by the covering portion, and a part between the fixing portion and the head cover is covered by the covering portion. For this reason, since the part between the fixing portion and the head cover does not function as an antenna, radiation of electromagnetic wave noise is reduced.

According to another aspect of the invention, there is provide a liquid discharging apparatus including: a discharging portion which discharges liquid; a fixing portion which fixes the discharging portion; a circuit substrate for controlling discharge of the liquid; and a covering portion which connects the fixing portion and a part of the discharging portion to each other, and covers a part between the fixing portion and the discharging portion.

In this case, the fixing portion and a part of the discharging portion are connected to each other by the covering portion, and a part between the fixing portion and the discharging portion is covered by the covering portion. For this reason, since the part between the fixing portion and the discharging portion does not function as an antenna, radiation of electromagnetic wave noise is reduced.

In addition, it is preferable that a part of the discharging portion is a nozzle plate on which a discharging port of the liquid is formed, or a fixing plate which is fixed to the nozzle plate.

It is preferable that a plurality of covering portions are provided at a predetermined interval.

Here, it is preferable that, when a signal having frequency f is supplied to the circuit substrate, the predetermined interval is shorter than a value of c/f which is obtained from a value of the frequency f and a value of light velocity c.

In addition, it is preferable that the covering portion fits and connects the fixing portion and the head cover to each other. In this configuration, the fixing portion and the head cover are easily connected to each other.

It is preferable that the fixing portion and the head cover are formed of metal, and at least one of the fixing portion, the head cover, and the covering portion are electrically grounded. In this configuration, shielding properties of electromagnetic wave noise is improved.

It is preferable that the covering portion fits and connects the fixing portion and a part of the discharging portion to each other. In this configuration, the fixing portion and a part of the discharging portion are easily connected to each other.

It is preferable that the fixing portion and a part of the discharging portion are formed of metal, and at least one of the fixing portion, a part of the discharging portion, and the covering portion is electrically grounded. In this configuration, shielding properties of electromagnetic wave noise are improved.

In addition, the invention is not limited to the liquid discharging apparatus, and can realize various aspects, for example, the ability to be conceptualized as a single body of a liquid discharging module.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention for carrying out the invention will be described with reference to the drawings.

Figure 1:
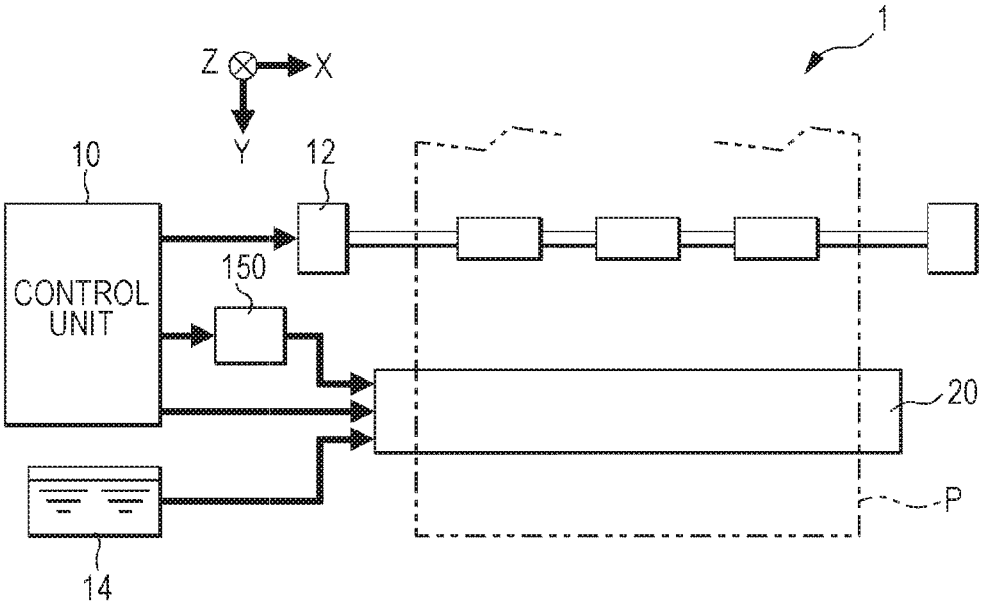
FIG. 1 is a view illustrating a schematic configuration of a printing apparatus according to an embodiment.

FIG. 1 is a view illustrating a schematic configuration of a printing apparatus 1 according to the embodiment.

The printing apparatus 1 is an ink jet printer which forms an ink dot group on a printing medium P, such as a paper sheet, by discharging ink (liquid), and accordingly, prints an image (including characters, figures or the like) in accordance with corresponding image data.

As illustrated in FIG. 1, the printing apparatus 1 includes a control unit 10, a transporting mechanism 12, a liquid discharging module 20, and a driving substrate 150. In addition, in the printing apparatus 1, a liquid container (cartridge) 14 in which a plurality of colors of ink are stored is mounted. In this example, a total of 4 colors of ink, such as cyan (C), magenta (M), yellow (Y), and black (Bk) are stored in the liquid container 14.

As will be described later, the control unit 10 includes a control portion which mainly performs processing with respect to image data supplied from an external host computer or controls each element of the printing apparatus 1, or a sending portion which sends a signal output from the control portion. The transporting mechanism 12 transports the printing medium P based on the control by the control unit 10 in a Y direction. The liquid discharging module 20 discharges the ink stored in the liquid container 14 onto the printing medium P based on the control by the control unit 10. The liquid discharging module 20 in the embodiment is a line head which is long in an X direction that intersects (in general, orthogonally) the Y direction. The driving substrate 150 generates and amplifies a driving signal or the like which will be described later following the control unit 10, and supplies the signal to the liquid discharging module 20.

In the printing apparatus 1, as the liquid discharging module 20 is synchronized with the transporting of the printing medium P by the transporting mechanism 12, and discharges the ink onto the printing medium P, an image is formed on a front surface of the printing medium P.

In addition, a direction which is perpendicular to an X-Y plane (parallel plane on the front surface of the printing medium P) will be written as a Z direction hereinafter. The Z direction is generally a discharging direction of the ink from the liquid discharging module 20.

Figure 2:
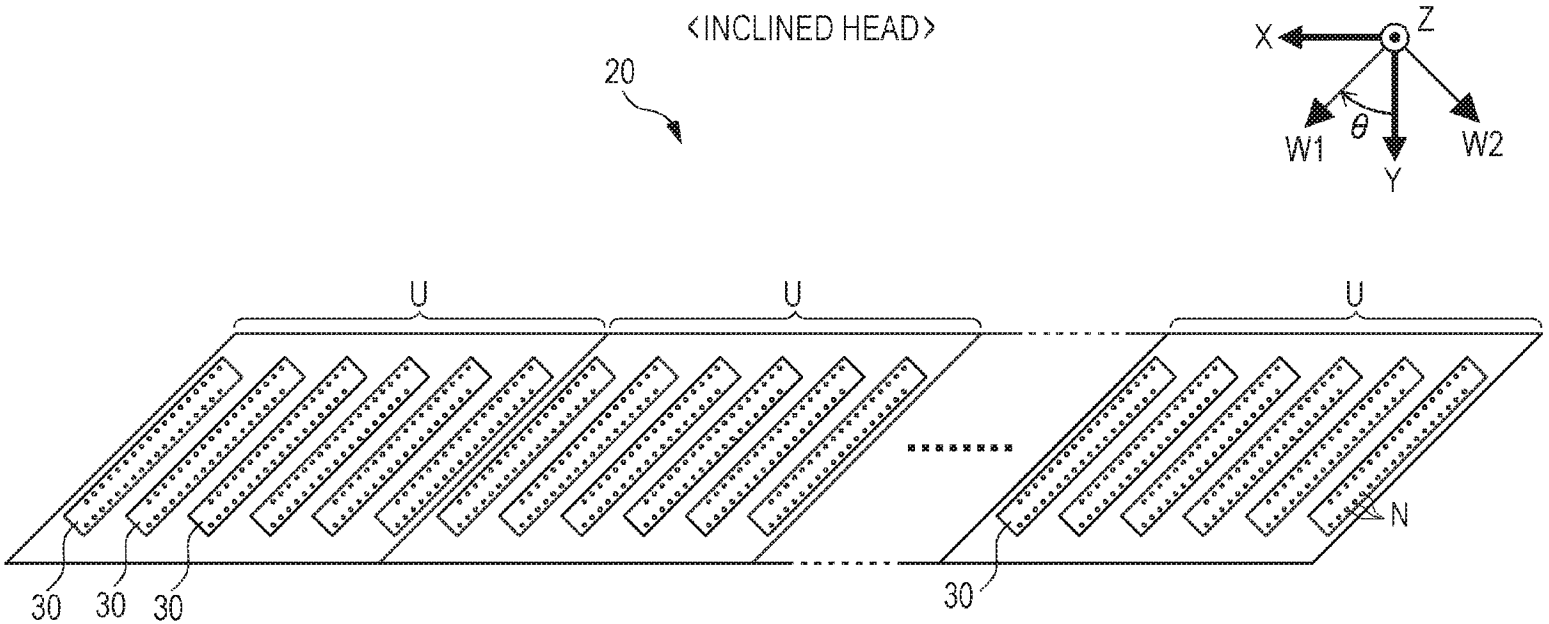
FIG. 2 is a plan view of main portions of a liquid discharging module.

FIG. 2 is a view illustrating an ink discharging surface in the liquid discharging module 20, and is a plan view when viewed from the recording medium P.

As illustrated in FIG. 2, in the liquid discharging module 20, a plurality of liquid discharging units U which are a base body are configured to be arranged along the X direction. A liquid discharging unit U further includes a plurality of liquid discharging heads 30 arranged along the X direction. The liquid discharging head 30 has a plurality of nozzles N which are inclined with respect to the Y direction which is a transporting direction of the printing medium P and are arranged in two rows.

In addition, for convenience of description in the embodiment, the number of the liquid discharging units U which configure the liquid discharging module 20 is "4", and further, the number of the liquid discharging heads 30 which configure the liquid discharging unit U is "6". Therefore, a total number of the liquid discharging heads 30 in the liquid discharging module 20 is "24".

In addition, the liquid discharging module 20 includes an aggregate substrate, a relay substrate, a head cover, and a base block, in addition to the four liquid discharging units U.

Figure 3:
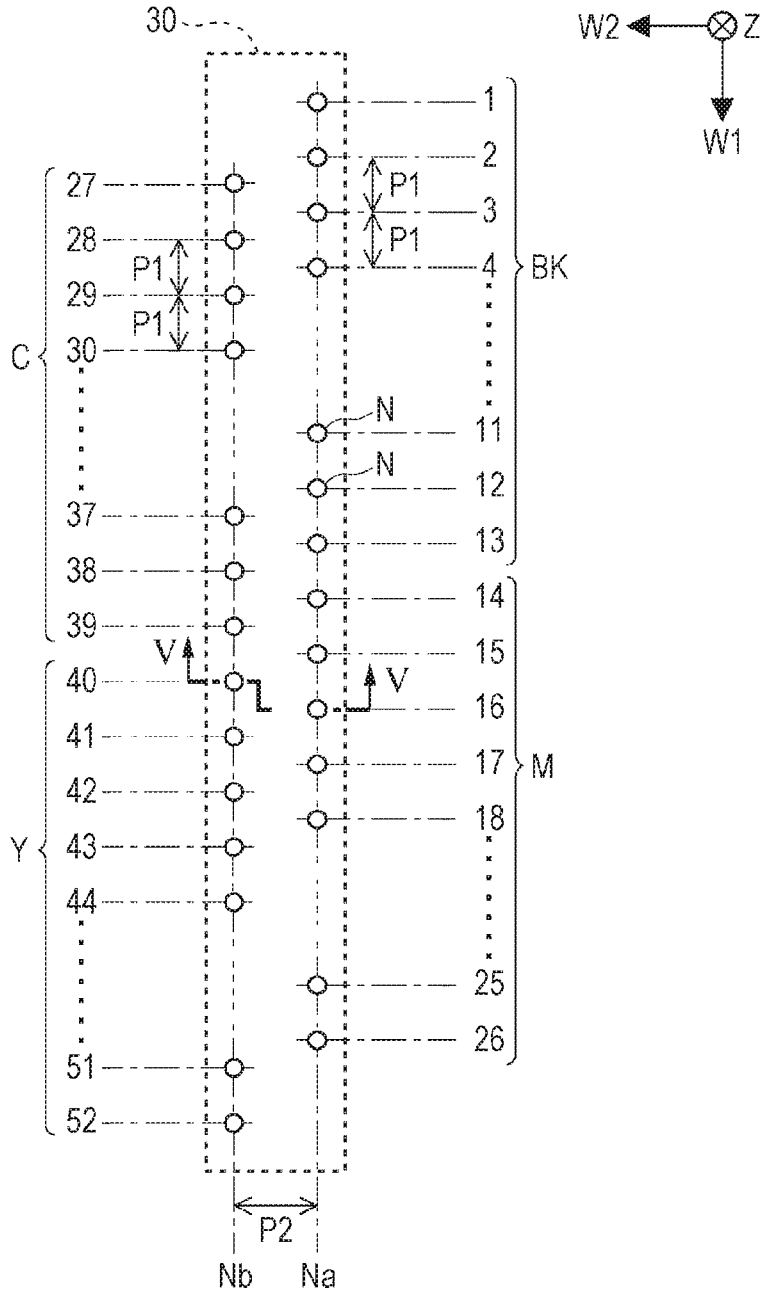
FIG. 3 is a view illustrating arrangement of nozzles in a liquid discharging head.

FIG. 3 is a view illustrating arrangement of the nozzles N in the liquid discharging head 30. Unlike FIG. 2, FIG. 3 is a view when projected in the discharging direction of the ink from a side opposite to the recording medium P. As described above, one liquid discharging head 30 has the plurality of nozzles N which are inclined in two rows, but here, first, the arrangement of the nozzles which are a single body of the liquid discharging head 30 without considering the inclination will be described.

As illustrated in FIG. 3, the nozzles of the liquid discharging head 30 are divided into nozzle rows Na and Nb. In the nozzle rows Na and Nb, each of the plurality of nozzles is respectively arranged at a pitch P1 along a W1 direction. In addition, the nozzle rows Na and Nb are separated from each other by a pitch P2 in a W2 direction which is orthogonal to the W1 direction. The nozzles N included in the nozzle row Na and the nozzle N included in the nozzle row Nb have a relationship of being shifted by a half of the pitch P1 in the W1 direction.

In FIG. 3, nozzle numbers for specifying the nozzles N or the like in the following are illustrated. In this example, the nozzles in the nozzle row Na are given the nozzle numbers 1, 2, . . . , 25, 26 in order from the nozzle N which is disposed in an end portion on a negative side (upper side in the drawing) in the W1 direction. The nozzles in the nozzle row Nb are given the nozzle numbers 27, 28, . . . , 51, 52 in order from the nozzle N which is disposed in an end portion on the negative side in the W1 direction.

In FIG. 3, a correspondence relationship with colors of the ink discharged from the nozzles N is also illustrated. In this example, the nozzles N having the nozzle numbers from "1" to "13" correspond to black (Bk), the nozzles N having the nozzle numbers from "14" to "26" correspond to magenta (M), the nozzles N having the nozzle numbers from "27" to "39" correspond to cyan (C), and the nozzles N having the nozzle numbers from "40" to "52" correspond to yellow (Y).

In addition, in FIG. 3, the number of the nozzles N is "52", but this is merely an example for convenience of description.

Figure 4:
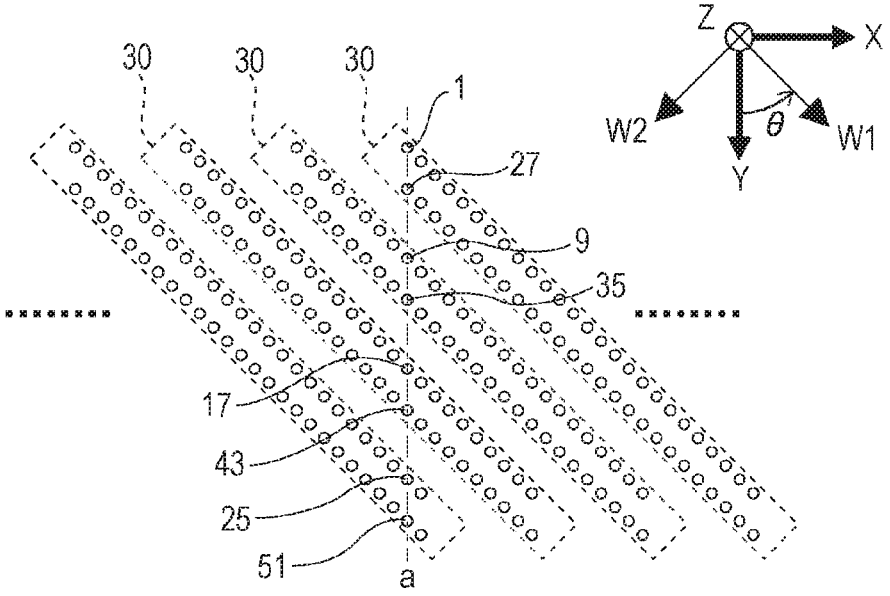
FIG. 4 is a view illustrating the arrangement of the nozzles in the liquid discharging head.

FIG. 4 is a view illustrating a positional relationship between the nozzles N when the liquid discharging heads 30 are arranged on an inclination. Similar to FIG. 3, FIG. 4 illustrates a case when a view is projected in the discharging direction of the ink from the side opposite to the recording medium P. For this reason, it is noted that inclination directions in FIGS. 2 and 4 are reverse to each other.

The liquid discharging heads 30 illustrated in FIG. 4 are arranged being inclined at an angle θ in a non-parallel and non-orthogonal state with respect to the Y direction which is the transporting direction of the printing medium P. At this time, in the example of FIG. 4, positions (coordinates) of the nozzles N included in the nozzle row Na and the nozzles N included in the nozzle row Nb in the X direction are common.

For example, when focusing on the liquid discharging head 30 at a right end in FIG. 4, the angle θ is set so that one nozzle N (the nozzle N having the nozzle number "1") which is positioned in the end portion on the negative side in the W1 direction in the nozzle row Na, and one nozzle N (nozzle N having the nozzle number "27") which is positioned in the end portion on the negative side in the W1 direction in the nozzle row Nb in the focused liquid discharging head 30, pass through a virtual line a which extends in a direction parallel to the Y direction.

In addition, the liquid discharging heads 30 which are on the periphery of the focused liquid discharging head have a positional relationship as follows. In other words, a second left liquid discharging head 30 of the focused liquid discharging head 30 in FIG. 4 have a positional relationship in which the nozzle N having the nozzle number "17" and the nozzle N having the nozzle number "43" pass through the virtual line a.

For this reason, when the printing medium P is transported in the Y direction, the black (Bk) ink discharged from the nozzle N having the nozzle number "1" and the cyan (C) ink discharged from the nozzle N having the nozzle number "27", in a certain liquid discharging head 30, and the magenta (M) ink discharged from the nozzle N having the nozzle number "17" and the yellow (Y) ink discharged from the nozzle N having the nozzle number "43" in second left liquid discharging head 30 of the corresponding liquid discharging head 30, land at substantially the same position, and accordingly, it is possible to form a color dot.

In addition, the nozzle N having the nozzle number "9" and the nozzle N having the nozzle number "35" in first left liquid discharging head 30 of the focused liquid discharging head 30, and the nozzle N having the nozzle number "25" and the nozzle N having the nozzle number "51" in third left liquid discharging heads 30 of the focused liquid discharging head 30, also have the positional relationship of passing through the virtual line a. For this reason, since each color of nozzles N overlaps two by two on the virtual line a, for example, processing of discharging the ink only from the nozzle N positioned on an upstream side and restricting the discharge of the ink from the nozzle N positioned on a downstream side is performed.

In addition, in FIG. 4, only the nozzle numbers which pass through the virtual line a are illustrated, but for example, the positions of the nozzles N having the nozzle numbers "2" and "28" in the focused liquid discharging head, and the nozzles N having the nozzle numbers "18" and "44" in the second left liquid discharging heads 30 of the focused liquid discharging head 30 in the X direction, are common. When viewed along the Y direction, nozzles having four colors pass through the virtual line a. Other nozzles also have a similar positional relationship.

Figure 5:
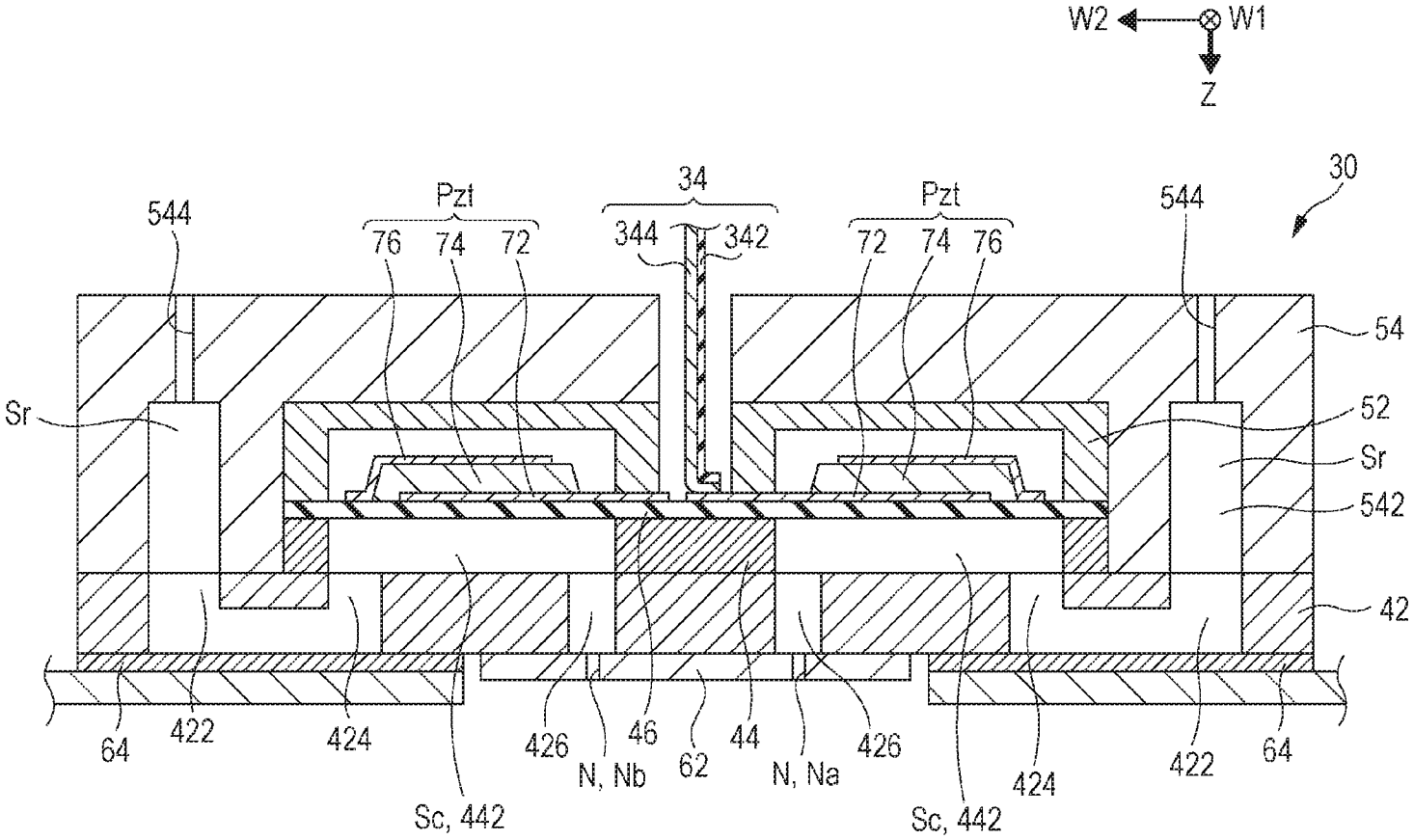
FIG. 5 is a sectional view of the liquid discharging head.

FIG. 5 is a sectional view illustrating a structure of the liquid discharging head 30. Specifically, FIG. 5 is a sectional view (a sectional surface which is perpendicular to the W1 direction, and a sectional surface when viewed in a negative side direction from a positive side in the W1 direction) of a case when broken by a g-g line in FIG. 3.

As illustrated in FIG. 5, in the liquid discharging head 30, a structure (head chip) in which a nozzle plate 62 and a compliance portion 64 are installed on a surface on the positive side in the Z direction while a pressure chamber substrate 44, a diaphragm 46, a sealing body 52, and a supporting body 54 are provided on the surface on the negative side in the Z direction on a channel substrate 42, is employed. Each element of the liquid discharging head 30 is a member having a shape of a substantially flat plate which is long in the W1 direction as schematically described above, and is mutually fixed by using an adhesive, for example. In addition, the channel substrate 42 and the pressure chamber substrate 44 are formed of a silicon single crystal substrate, for example.

The nozzles N are formed on the nozzle plate 62 which is made of metal, for example. As schematically illustrated in FIG. 3, in the liquid discharging head 30, a structure which corresponds to the nozzles included in the nozzle row Na and a structure which corresponds to the nozzles included in the nozzle row Nb have a relationship of being shifted by a half of the pitch P1 in the W1 direction, but in addition to this, since the structures are formed in a substantially symmetric manner, hereinafter, the structure of the liquid discharging head 30 will be described focusing on the nozzle row Na.

The channel substrate 42 is a flat plate member which forms an ink channel, and an opening portion 422, a supply channel 424, a communication channel 426 are formed. The supply channel 424 and the communication channel 426 are formed in every nozzle, and the opening portion 422 is formed to be continuous across the plurality of nozzles which discharge the same color of ink.

The supporting body 54 is fixed to the front surface on the negative side in the Z direction on the channel substrate 42. A receiving portion 542 and an introduction channel 544 are formed in the supporting body 54. In a plan view (that is, when viewed in the Z direction), the receiving portion 542 is an externally concave portion (recess) that corresponds to the opening portion 422 of the channel substrate 42, and the introduction channel 544 is a channel which communicates with the receiving portion 542.

A space which makes the opening portion 422 of the channel substrate 42 and the receiving portion 542 of the supporting body 54 communicate with each other functions as a liquid storage chamber (reservoir) Sr. The liquid storage chamber Sr is formed independently for each color of ink, and stores the ink which passes through the liquid container 14 (refer to FIG. 1) and the introduction channel 544. In other words, four liquid storage chambers Sr which correspond to different colors of ink are formed inside one liquid discharging head 30.

An element which configures a bottom surface of the liquid storage chamber Sr and suppresses (absorbs) pressure variation of the ink in the liquid storage chamber Sr and the internal channel is the compliance portion 64. The compliance portion 64 is configured to include, for example, a flexible member formed in a sheet shape, and specifically, is fixed to the front surface of the channel substrate 42 to close the opening portion 422 and the supply channel 424 on the channel substrate 42.

The diaphragm 46 is installed on the front surface on the side opposite to the channel substrate 42 on the pressure chamber substrate 44. The diaphragm 46 is a member having a shape of a flat plate that can elastically vibrate, and is configured of a lamination layer of an elastic film formed of an elastic member, such as silicon oxide, and an insulation film formed of an insulating material, such as zirconium oxide. The diaphragm 46 and the channel substrate 42 oppose each other at an interval on inner sides of each opening portion 442 of the pressure chamber substrate 44. A space which is nipped between the channel substrate 42 and the diaphragm 46 on the inside of each opening portion 442 functions as a pressure chamber Sc which imparts pressure to the ink. Each pressure chamber Sc communicates with the nozzle N via the communication channel 426 of the channel substrate 42.

On the front surface on the side opposite to the pressure chamber substrate 44 on the diaphragm 46, a piezoelectric element Pzt which corresponds to the nozzle N (pressure chamber Sc) is formed.

The piezoelectric element Pzt includes a driving electrode 72 which is formed separately in every piezoelectric element Pzt on a surface of the diaphragm 46, a piezoelectric substance 74 which is formed on a surface of the driving electrode 72, and a driving electrode 76 which is formed on a surface of the piezoelectric substance 74. In addition, regions which oppose each other nipping the piezoelectric substance 74 by the driving electrodes 72 and 76 function as the piezoelectric element Pzt.

The piezoelectric substance 74 is formed in a process including heat treatment (firing), for example. Specifically, the piezoelectric substance 74 is formed by molding (for example, milling which uses plasma) a piezoelectric material to coat on the front surface of the diaphragm 46 on which the plurality of driving electrodes 72 are formed in every piezoelectric element Pzt after the firing by the heat treatment inside a furnace.

A part of the driving electrode 72 is exposed from the sealing body 52 and the supporting body 54, and at the exposed part, one end of a wiring substrate 34 is fixed by the adhesive.

The wiring substrate 34 is a substrate made by patterning a plurality of wirings 344 on an insulating and flexible base film 342, such as polyimide, and which has a semiconductor chip mounted thereon as will be described later. The driving electrode 72 is electrically connected to the wiring 344 of the wiring substrate 34, and a voltage Vout of the driving signal is applied separately to one end of the piezoelectric element Pzt by this connection.

Meanwhile, although not illustrated in the drawing, the driving electrodes 76 are commonly connected to each other across the plurality of piezoelectric elements Pzt, are drawn around from the sealing body 52 and the supporting body 54 to the exposed part, and are electrically connected to another wiring 344 on the wiring substrate 34. By this connection, a positive voltage (for example, a voltage $V_{BS}$ which will be described later) is commonly applied to the other end of the plurality of piezoelectric elements Pzt.

In case of the piezoelectric element Pzt having such a configuration, in accordance with the voltage applied by the driving electrodes 72 and 76, in FIG. 5, the center part with respect to the periphery together with the driving electrodes 72 and 76 and the diaphragm 46, bends upwardly or downwardly with respect to both end parts. Specifically, while the piezoelectric element Pzt bends upwardly when the voltage Vout of the driving signal applied via the driving electrode 72 decreases, the piezoelectric element Pzt bends downwardly when the voltage Vout increases.

Here, when the piezoelectric element Pzt bends upwardly, an internal volume of the pressure chamber Sc expands, and thus, the ink is drawn from the liquid storage chamber Sr. Meanwhile, when the piezoelectric element Pzt bends downwardly, the internal volume of the pressure chamber Sc is reduced, and thus, ink droplets are discharged from the nozzle N as much as the amount of reduction.

In this manner, when the appropriate driving signal is applied to the piezoelectric element Pzt, the ink is discharged from the nozzle N by displacement of the piezoelectric element Pzt. Therefore, the discharging portion which discharges the ink is configured of an element including the pressure chamber Sc, the nozzle N and the like, together with the piezoelectric element Pzt.

Figure 6:
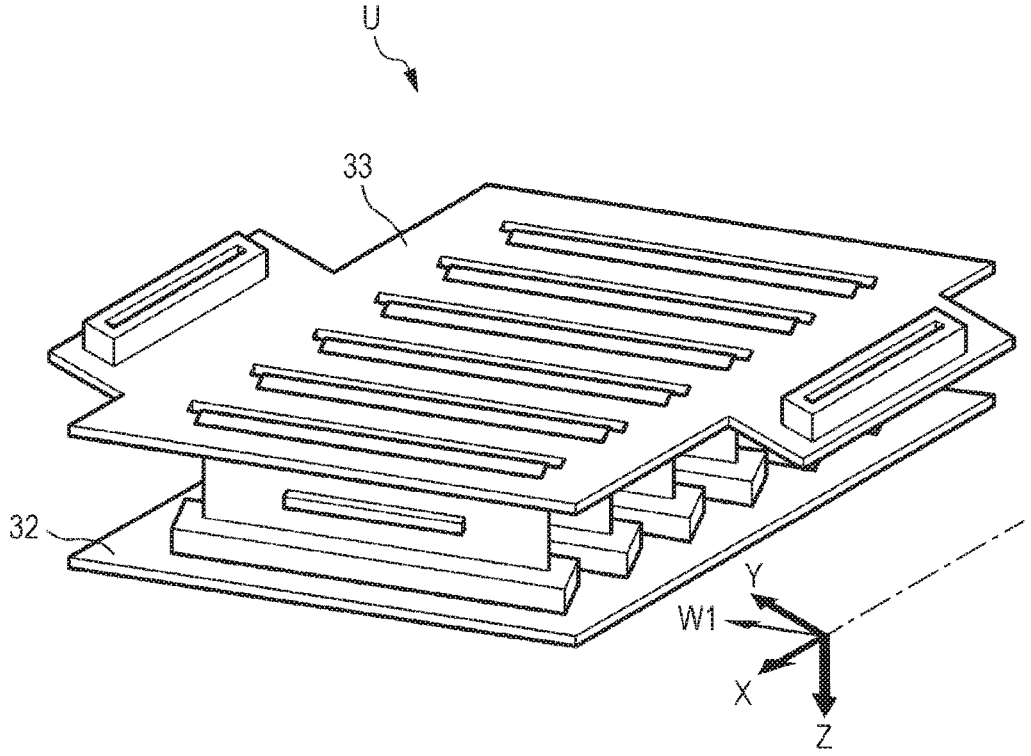
FIG. 6 is a perspective view of a liquid discharging unit.
Figure 7:
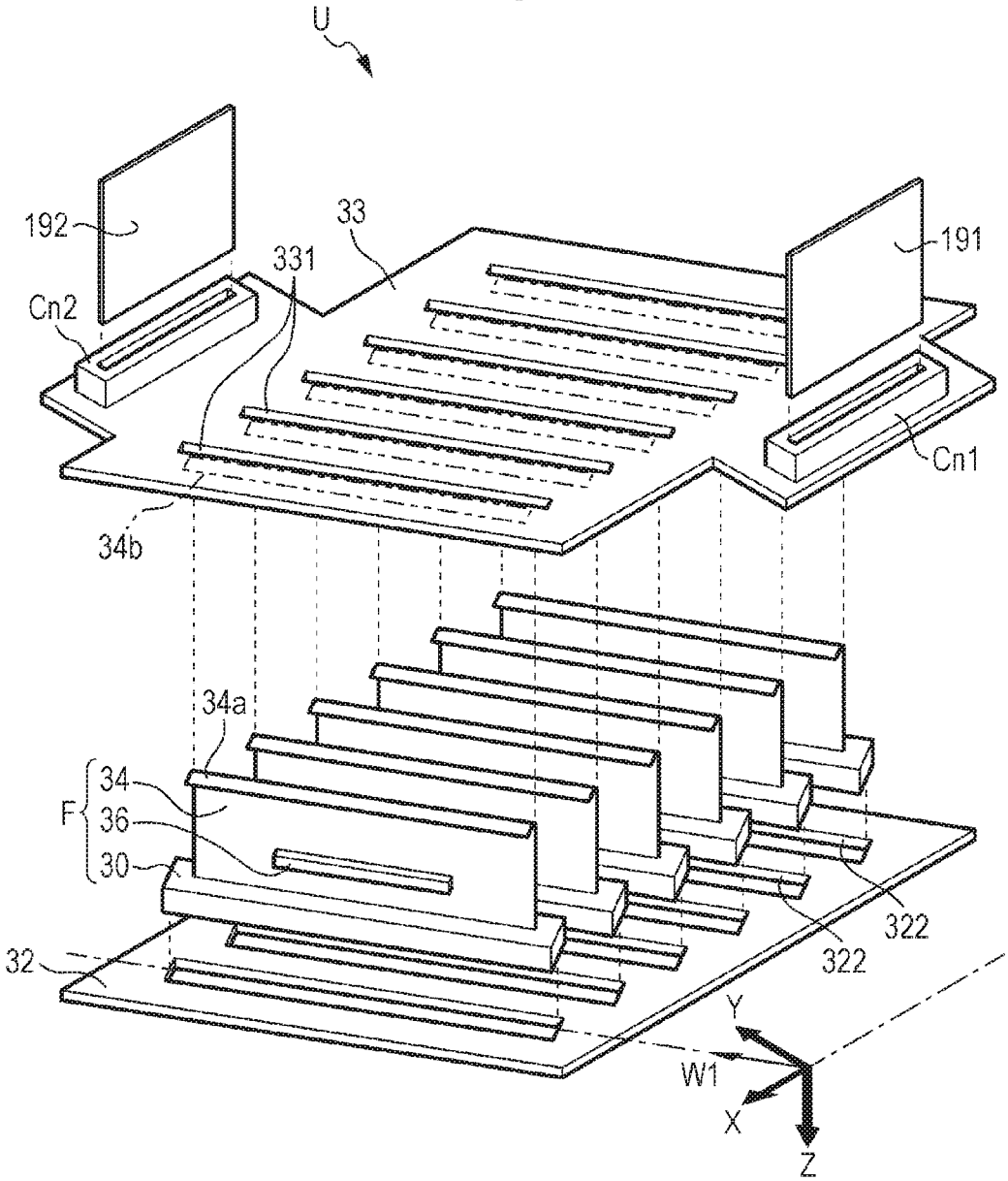
FIG. 7 is an exploded perspective view of the liquid discharging unit.

FIG. 6 is a perspective view illustrating a configuration of one liquid discharging unit U. FIG. 7 is an exploded perspective view of the liquid discharging unit U in FIG. 6.

In particular, as illustrated in FIG. 7, six opening portions 322 are formed on a fixing plate 32 having a shape of a flat plate which is made of metal, for example. Each of the six liquid discharging heads 30 is respectively fixed to the front surface of the fixing plate 32 so that the nozzle N is exposed in the opening portion 322.

On a head substrate 33, six slits 331 are provided corresponding to each of the liquid discharging heads 30. After being inserted to the slit 331, the other end 34*a* of the wiring substrate 34 is connected to a terminal provided in a region 34*b* on an upper surface on the head substrate 33 by the adhesive or by soldering, as illustrated in FIG. 6.

On the head substrate 33, a connector Cn1 is provided on the positive side in the Y direction, and a plurality of signals of an analog system which will be described later are supplied via a flexible flat cable (FFC) 191. Meanwhile, on the head substrate 33, a connector Cn2 is provided on the negative side in the Y direction, and a plurality of signals of a digital system which will be described later are supplied via an FFC 192.

On the head substrate 33, wiring (not illustrated) which is led to the terminal provided in the region 34*b* performs patterning with respect to the signal of the analog system and the signal of the digital system. For this reason, when the other end 34*a* of the wiring substrate 34 is connected to the region 34*b* of the head substrate 33, the signal of the analog system supplied to the connector Cn1 and the signal of the digital system supplied to the connector Cn2 are transferred to a semiconductor chip 36 mounted on the wiring substrate 34.

In this manner, firstly, the signal of the analog system and the signal of the digital system are supplied to the liquid discharging unit U in a separated state. In other words, when viewed in a plan view in the Z direction, the signal of the analog system is supplied from one side (upstream side in the transporting direction of the printing medium P) with respect to the arrangement of the liquid discharging head 30, and the signal of the digital system is supplied from the other end (downstream side in the transporting direction of the printing medium P), and secondly, the signal is supplied to the semiconductor chip 36 via the head substrate 33 and the wiring substrate 34.

In addition, for convenience of description, there is a case where the liquid discharging head 30, the wiring substrate 34, and the semiconductor chip 36 mounted on the wiring substrate 34 are called a head block F. In other words, here, the head block F is an aggregate of an electrical functional block which includes the liquid discharging head 30, the wiring substrate 34 connected to the liquid discharging head 30, and the semiconductor chip 36 mounted on the wiring substrate 34.

Figure 8:
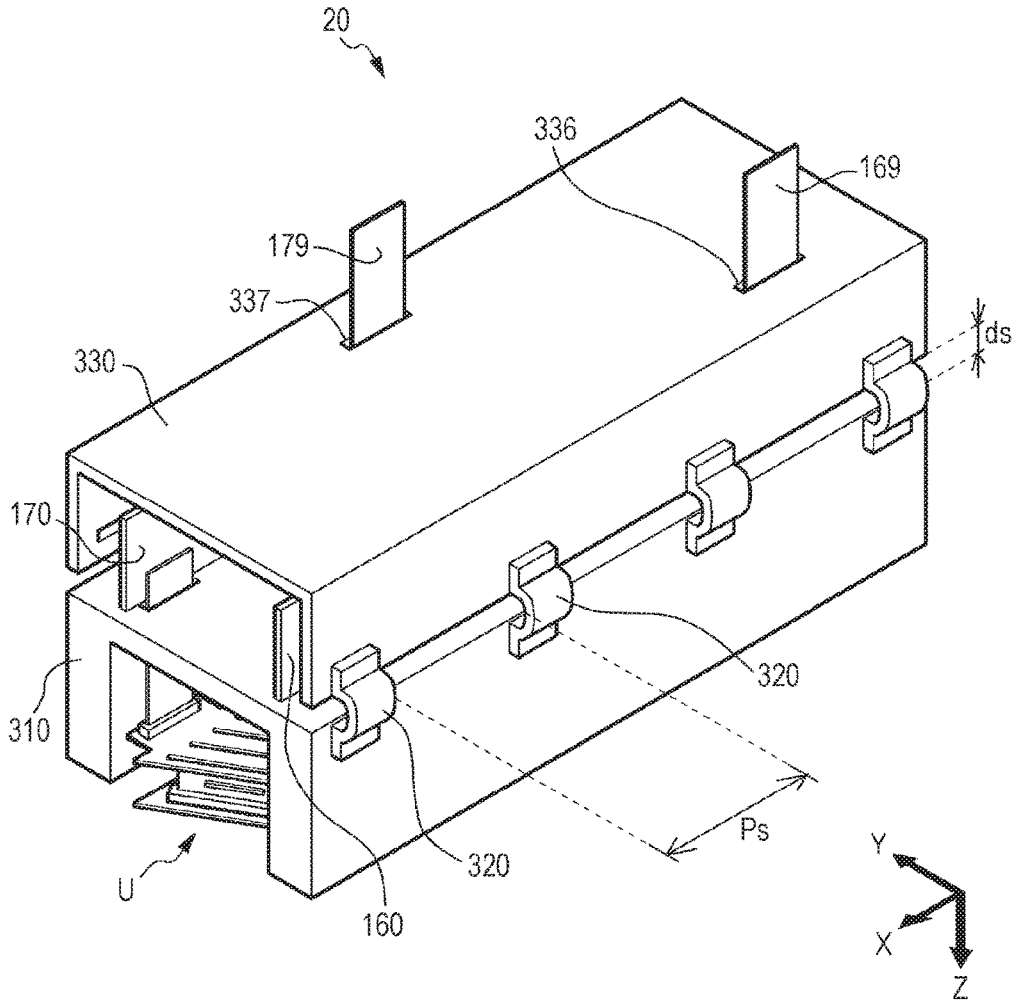
FIG. 8 is a perspective view of the liquid discharging module.
Figure 9:
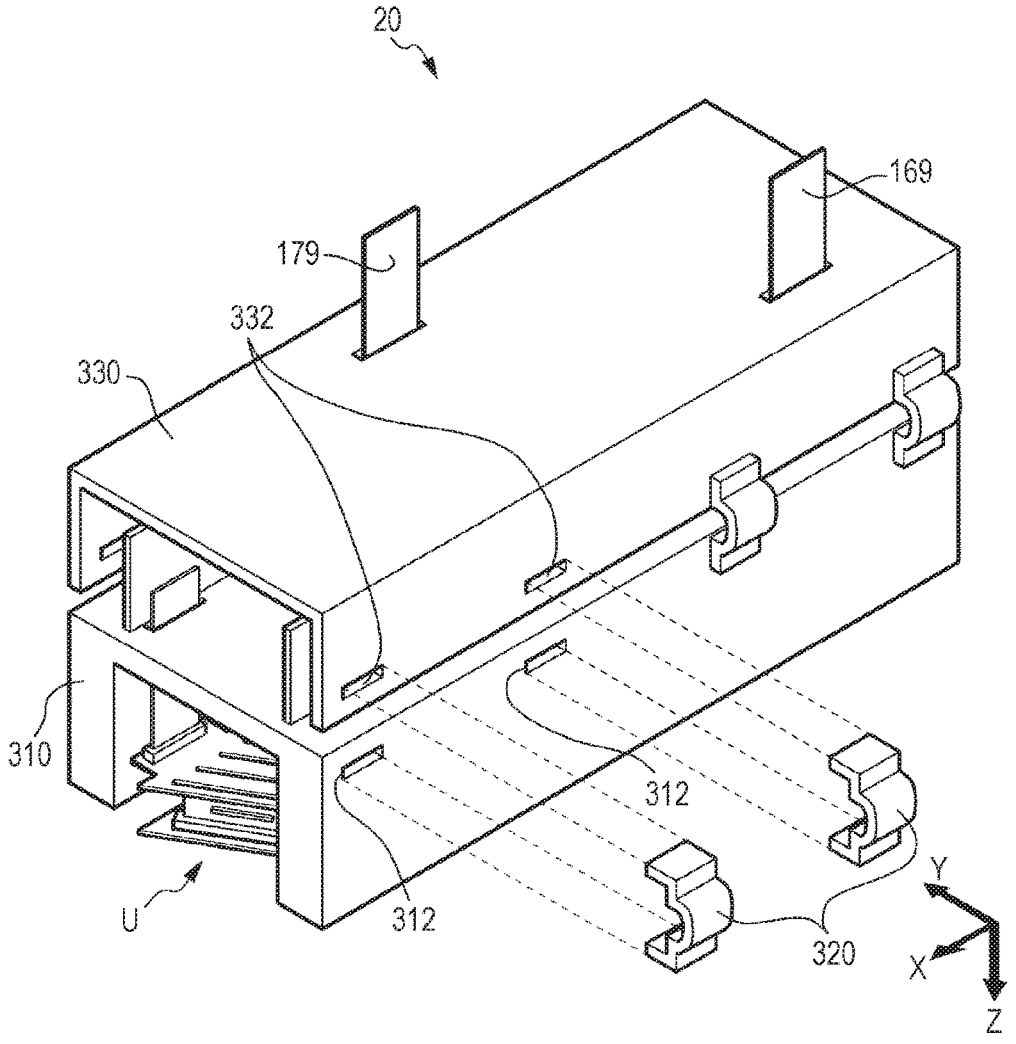
FIG. 9 is an exploded perspective view of the liquid discharging module.
Figure 10:
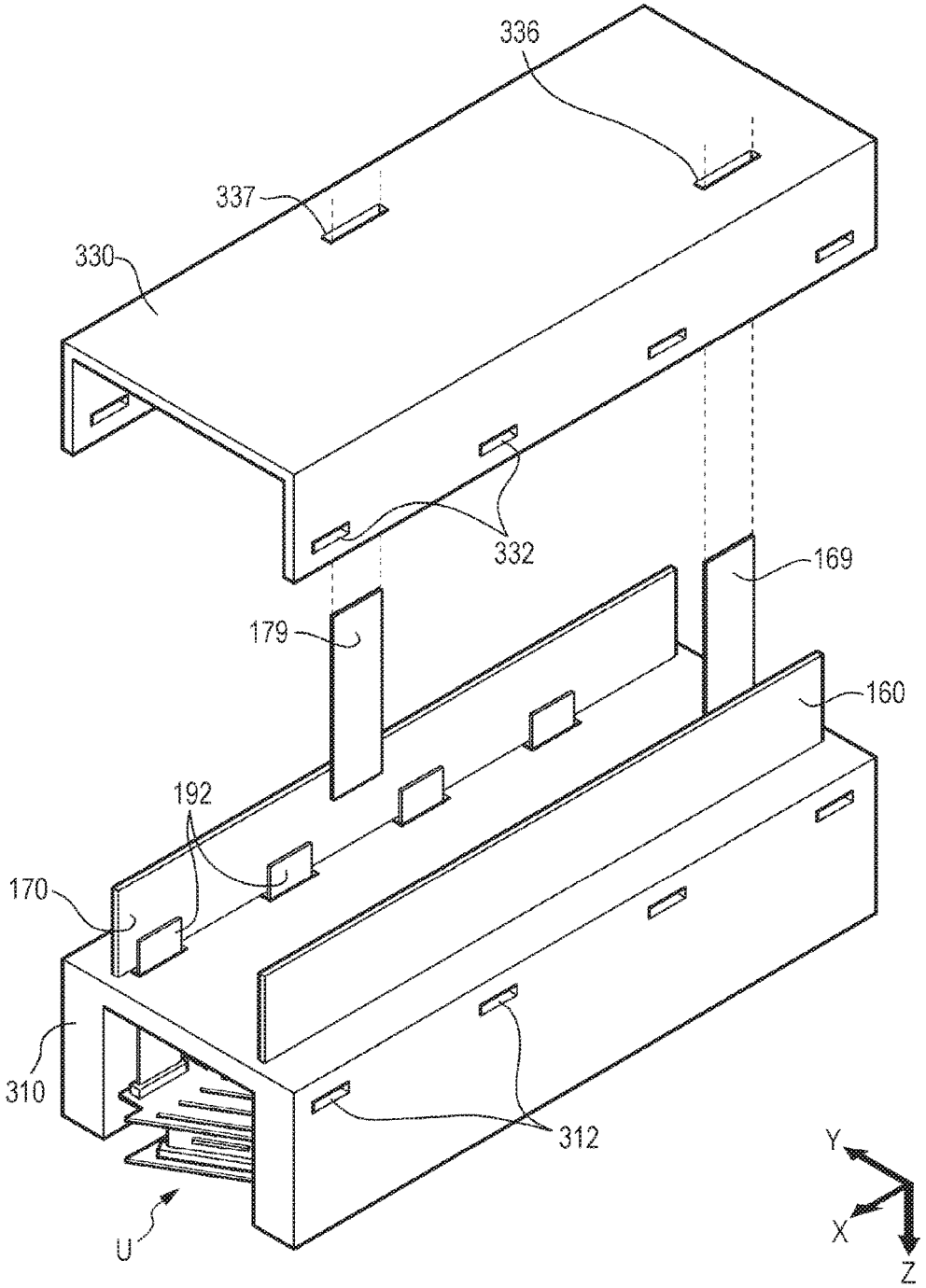
FIG. 10 is an exploded perspective view of the liquid discharging module.
Figure 11:
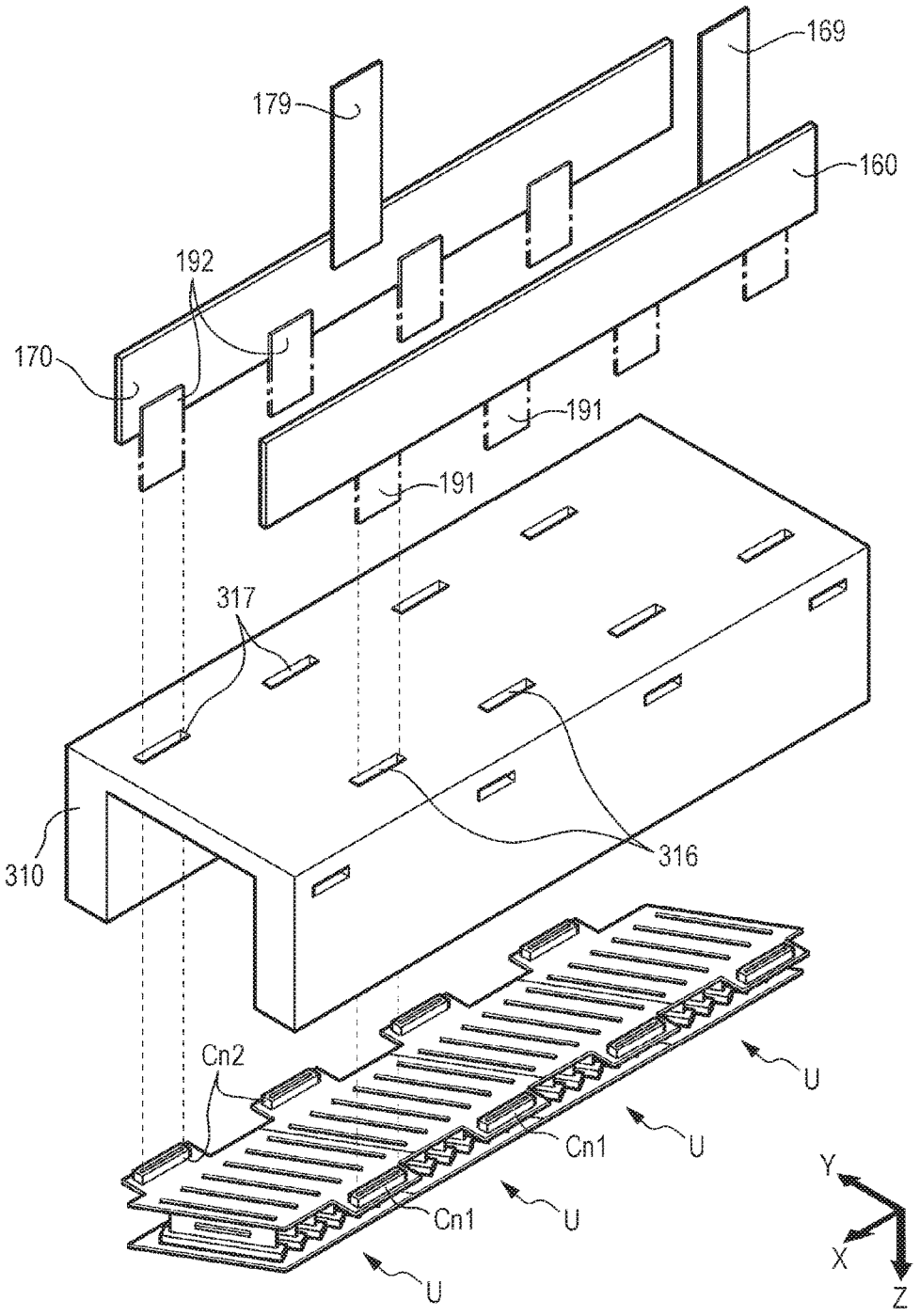
FIG. 11 is an exploded perspective view of the liquid discharging module.

FIG. 8 is a perspective view illustrating a configuration of the liquid discharging module 20. FIGS. 9 to 11 are exploded perspective views of the liquid discharging module 20 in FIG. 8.

As illustrated in FIG. 8, the liquid discharging module 20 includes four liquid discharging units U, a base block 310, a head cover 330, a relay substrate 160, and an aggregate substrate 170.

The base block 310 (fixing portion) is, for example, an aluminum casting product in which a sectional surface is formed in an inverted U shape, and fixes the liquid discharging unit U by a plate spring which will be described later to cover the four liquid discharging units U. In addition, the base block 310 is grounded to a ground potential having a voltage of zero.

An electrical function of the relay substrate 160 and the aggregate substrate 170 which are circuit substrates will be described later, but above the base block 310, for example, the relay substrate 160 and the aggregate substrate 170 are screwed to the base block 310. The head cover 330 is made of a metal conductor, such as copper or iron, and is provided for electromagnetically shielding the relay substrate 160 and the aggregate substrate 170 from the outside world. However, the head cover 330 is not completely adhered to the base block 310, and a slit forming an interval ds is formed.

In order to divide a void along the X direction in this manner, the base block 310 and the head cover 330 are connected to each other by a plurality of members 320 (covering portions).

In addition, the plurality of members 320 are disposed at a substantially equivalent interval along the X direction. The length in the X direction when the slit at the interval ds between the base block 310 and the head cover 330 is divided by the member 320, is set to be Ps.

In addition, opening portions 336 and 337 are provided in the head cover 330. In particular, as illustrated in FIG. 10, one end of an FFC 169 connected to an upper end side of the relay substrate 160 is exposed through the opening portion 336, and an FFC 179 connected to an upper end side of the aggregate substrate 170 is exposed through the opening portion 337.

The member 320 is a member which is processed by bending an elastic metal plate, such as a phosphor bronze, and as illustrated in FIG. 9, one end thereof is inserted to an attachment hole 312 provided in the base block 310, and the other end thereof is inserted to an attachment hole 332 provided in the head cover 330.

For this reason, the plurality of members 320 are fitted to the base block 310 and the head cover 330, and electrically connects both the base block 310 and the head cover 330 to each other. Therefore, since the head cover 330 is grounded to the ground potential together with the base block 310, shielding properties which will be described later is improved.

In addition, in FIGS. 8 and 9, the member 320 illustrates a state of being provided on a front right side of a paper surface, but the member 320 is also provided on a rear left side of the paper surface. In addition, in the examples in FIGS. 8 and 9, the number of the members 320 is a total of 8 (4 among these are not illustrated) by providing 4 on each side, but the number may be 2 or more on each side so long as the length of the slit does not become equal to or longer than the length Ps.

FIG. 11 particularly illustrates a configuration in a previous stage of covering the base block 310 by the head cover 330, in the liquid discharging module 20.

In an upper portion of the base block 310, four opening portions 316 and 317 are respectively provided. Among these, the opening portion 316 is provided at a position which opposes the connector Cn1 in four liquid discharging units U, and the opening portion 317 is provided at a position which opposes the connector Cn2.

Four FFCs 191 are connected to a lower end side of the relay substrate 160, and one end of each of the FFCs 191 is connected to the connector Cn1 in the liquid discharging unit U via each of the opening portions 316. Similarly, four of the FFCs 192 are connected to a lower end side of the aggregate substrate 170, and one end of each of the FFCs 192 is connected to the connector Cn2 in the liquid discharging unit U via each of the opening portions 317.

Figure 12:
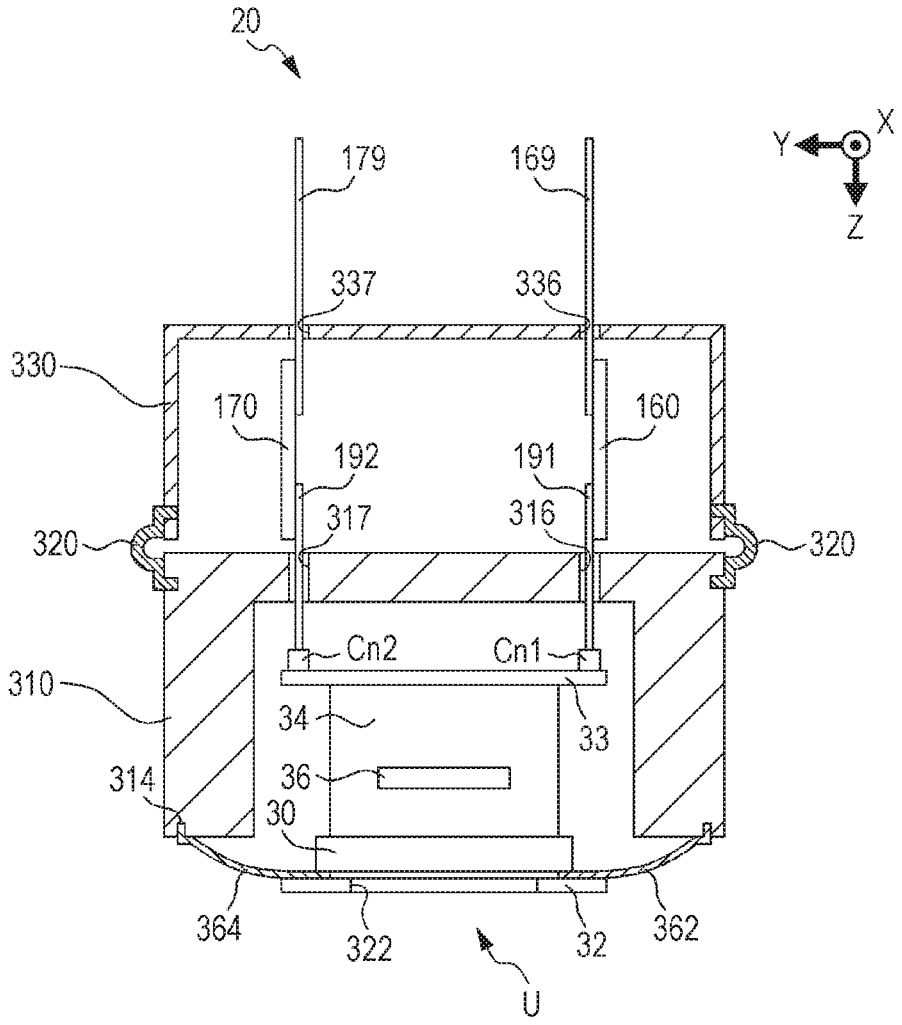
FIG. 12 is a sectional view illustrating a configuration of the liquid discharging module.

FIG. 12 is a sectional view illustrating a configuration of a case where the liquid discharging module 20 is broken by a Y-Z plane.

In FIG. 12, while one end of a plate spring 362 is fixed to the bottom surface of the base block 310, the other end of the plate spring 362 is inserted into a void between a fixing plate 32 and the channel substrate 42 in the liquid discharging unit U.

While one end of a member 364 (covering portion) is similarly fixed to the bottom surface of the base block 310 to the plate spring 362, the other end is inserted into the void between the fixing plate 32 and the channel substrate 42 in the liquid discharging unit U. Accordingly, the liquid discharging unit U is elastically held by the plate spring 362 and the member 364 with respect to the base block 310.

In addition, the plurality of members 364 are disposed at an interval Ps with respect to a paper surface perpendicular direction (X direction) similar to the member 320.

Meanwhile, while the driving signal or the like having a comparatively high voltage is supplied to the relay substrate 160 as will be described later, a clock signal or the like having a comparatively high frequency is supplied to the aggregate substrate 170. For this reason, the periphery of the relay substrate 160, the aggregate substrate 170, the head substrate 33, the semiconductor chip 36, or the liquid discharging head 30 becomes a source of noise by transmitting the high frequency and high voltage signal. Electromagnetic wave noise radiated from the source of noise is suppressed at a certain level by the base block 310 or the head cover 330. However, in the configuration in which the members 320 and 364 are not provided, a slit of the interval ds between the base block 310 and the head cover 330, or the void between the liquid discharging unit U and the base block 310 functions as an antenna, and the electromagnetic wave noise is still radiated.

In contrast to this, the length of the slit between the base block 310 and the head cover 330 in the X direction is suppressed to Ps by the member 320. Similarly, the length of the void between the liquid discharging unit U and the base block 310 in the X direction is also suppressed to Ps by the member 364.

Here, in the embodiment, when the highest frequency of the driving signal or the clock signal is set to be f and the light velocity is set to be c, the length Ps of the slit divided by the member 320 is set to be less than c/(4f), that is, less than ¼ of wavelength of electromagnetic wave noise. Accordingly, since the slit does not function as an antenna, it is possible to suppress the level at which electromagnetic wave noise is radiated from the source of noise to be low.

In addition, when the length Ps is less than c/f, it is confirmed that an effect of reduction of radiated noise is practically sufficient even though the effect is slightly worse compared to a case where the length Ps is less than c/(4f).

In addition, a configuration in which the slit or the void is shielded across the entire section is also considered, but since the configuration causes an increase in cost or weight, as described in the embodiment, a configuration in which partial shielding is performed by the members 320 and 364 is more advantageous.

The disposition or shape of each configuration element of the liquid discharging module 20 can be deformed in various manners as follows.

Figure 13:
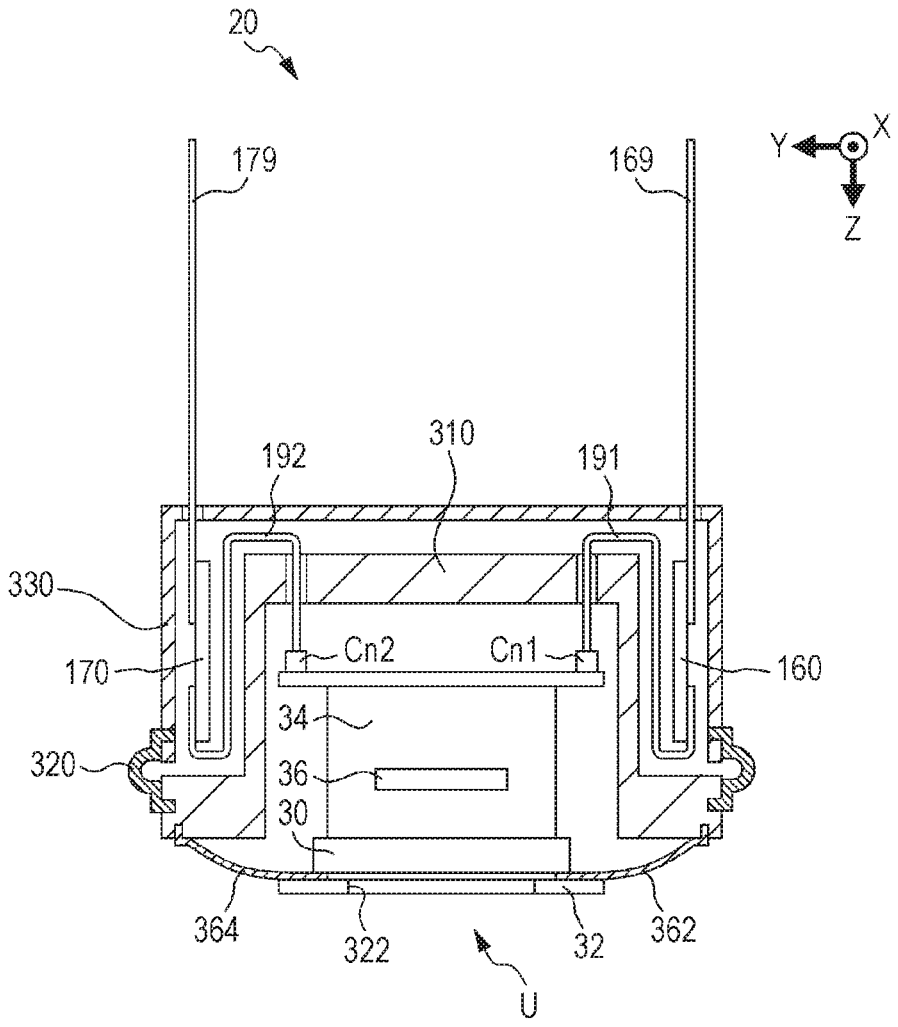
FIG. 13 is a partial sectional view illustrating a configuration of (first) another example of the liquid discharging module.

FIG. 13 is a sectional view illustrating a structure of (first) another example of the liquid discharging module 20. In (first) another example, an example in which the shape of the sectional surface of the base block 310 is changed, and the space formed by the base block 310 and the head cover 330 is small is described. By comparing this example with the configuration illustrated in FIG. 12, it is possible to reduce the size of the liquid discharging module 20 in the Z direction (height direction).

Figure 14:
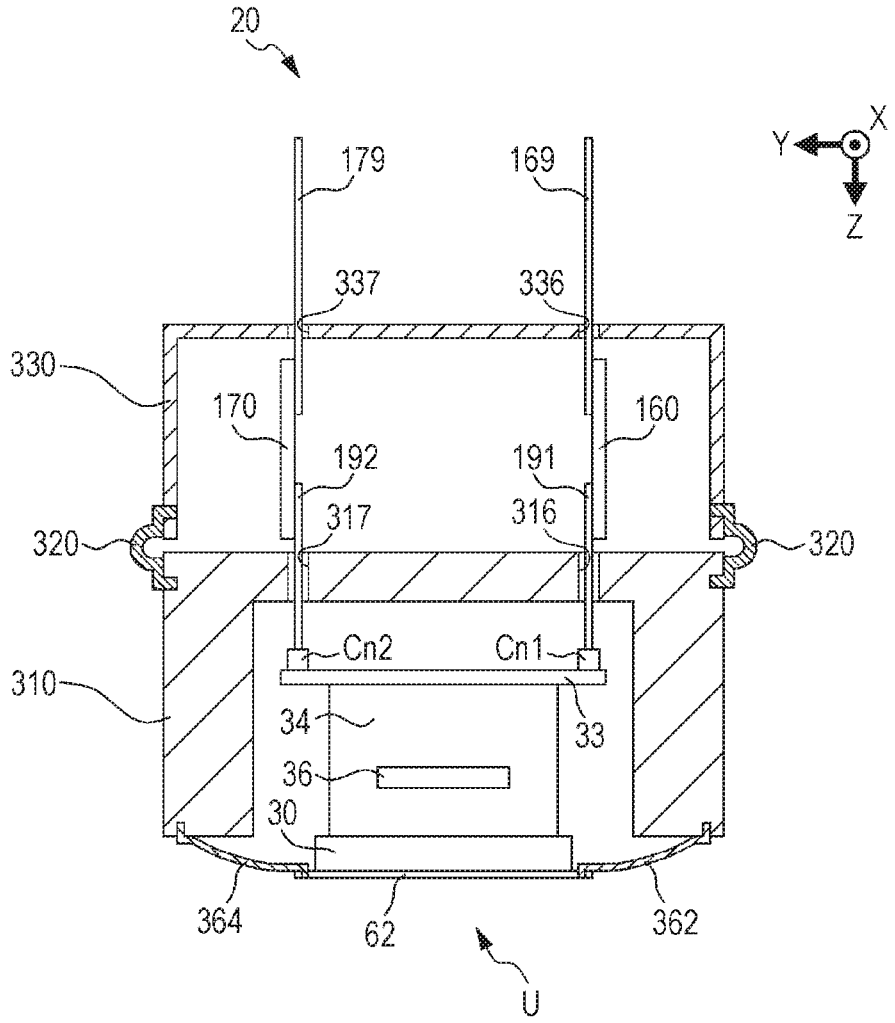
FIG. 14 is a partial sectional view illustrating a configuration of (second) another example of the liquid discharging module.

FIG. 14 is a sectional view illustrating a structure of (second) another example of the liquid discharging module 20. In (second) another example, the fixing plate 32 is not provided, and the nozzle plate 62 is widened instead. In addition, for example, the other end of the member 364 is inserted to the opening portion provided on the nozzle plate 62, and divides the void in the X direction generated in the liquid discharging unit U and the base block 310.

In addition, the member 320 (364) is connected by using the fitting between the base block 310 and the head cover 330 (fixing plate 32), but for example, may be connected by using an elastic force or a biasing force of the member itself. In any case, since screwing or the like is not necessary, metal powder is not generated.

The base block 310 and the head cover 330 have a structure of being opened on both ends on the positive and negative sides in the X direction, but a closed structure may also be employed.

Figure 15:
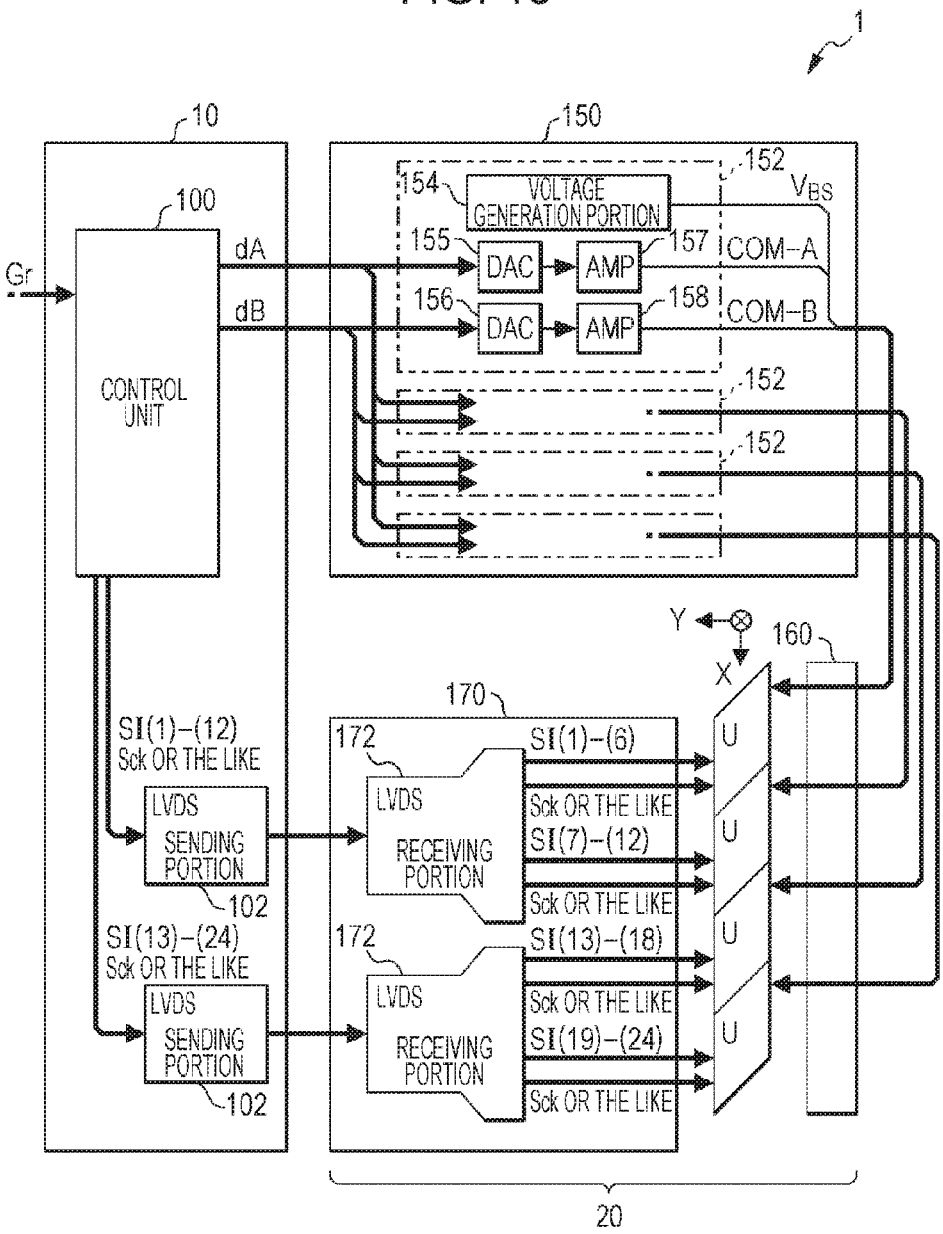
FIG. 15 is a block diagram illustrating a functional configuration in the printing apparatus.

FIG. 15 is a block diagram illustrating a functional configuration in the printing apparatus 1.

As described in FIG. 1, the printing apparatus 1, the control unit 10, the liquid discharging module 20, and the driving substrate 150 are included. Among these, the control unit 10 includes a control unit 100 and two sending portions 102. If summarizing, the control unit 100 performs processing as follows, or outputs the signal.

In other words, firstly, the control unit 100 outputs printing data SI(1) to SI(24) after performing image processing, such as complementing processing or arrangement conversion processing, by executing a predetermined program, with respect to image data Gr supplied from a host computer (not illustrated).

In addition, for example, when a defect of the nozzle is generated, the complementing processing means processing for forming a dot to be formed by the defective nozzle by using the nozzle which exists on the periphery of the defective nozzle, and for example, the arrangement conversion processing means processing for converting the image data Gr which regulates the arrangement of pixels on an orthogonal coordinate to a coordinate system in accordance with inclination arrangement of the nozzles N.

The printing data SI(1) to SI(24) is data which regulates the dot to be formed on the printing medium P in one printing cycle in every liquid discharging head 30. Here, when 24 liquid discharging heads 30 are distinguished by the numbers 1, 2, 3, . . . , 23, 24 in order from the negative side to the positive side in the X direction, the numbers 1 to 24 written in parentheses that follow the reference numeral SI of the printing data illustrate with which liquid discharging head 30 the data is supplied in accordance. For example, the printing data SI(3) illustrates that the data is supplied in accordance with the third liquid discharging head 30, and the printing data SI(19) illustrates that the data is supplied in accordance with the nineteenth liquid discharging head 30.

As described above, the liquid discharging unit U is configured of six liquid discharging heads 30. For this reason, the printing data SI(1) to SI(6), SI(7) to SI(12), SI(13) to SI(18), and SI(19) to SI(24) correspond to the first, second, third, and fourth liquid discharging units U in order from the negative side to the positive side in the X direction.

Secondly, the control unit 100 is synchronized with the printing data SI(1) to SI(24), and outputs a clock signal Sck and a control signals LAT and CH. In addition, as will be described later, since the driving signal supplied to one end of the piezoelectric element Pzt is controlled, there is a case where the printing data SI(1) to SI(24), the clock signal Sck, and the control signals LAT and CH are generically called a discharge control signal. In addition, among the discharge control signals, there is a case where the clock signal Sck and the control signals LAT and CH except for the printing data SI(1) to SI(24) are called the clock signal Sck or the like for convenience.

Thirdly, the control unit 100 is synchronized with the printing data SI(1) to SI(24), the clock signal Sck, and the control signals LAT and CH, and outputs digital data dA and dB. The data dA regulates a waveform of a driving signal COM-A, and the data dB regulates a waveform of a driving signal COM-B, among the driving signals supplied to the liquid discharging head 30.

In addition to this, the control unit 100 controls the transporting mechanism 12 and controls the transportation of the printing medium P in the Y direction, but the configuration for this will be omitted.

In addition, one sending portion 102 multiplexes a single end digital signal of the printing data, the clock signal Sck, and the control signals LAT and CH for two liquid discharging units U, and converts the signals to a differential signal, and sends the differential signal. As a transmission system of the differential signal, in the embodiment, a low voltage differential signaling (LVDS) is used.

In the embodiment, since four liquid discharging units U are provided, two sending portions 102 are used. In other words, the first sending portion 102 outputs the differential signal by multiplexing the printing data SI(1) to SI(12) and the clock signal Sck in accordance with the first and second liquid discharging units U, and the second sending portion 102 outputs the differential signal by multiplexing the printing data SI(13) to SI(24) and the clock signal Sck in accordance with the third and fourth liquid discharging units U.

In addition, in the drawing, two sending portions 102 are illustrated as separate bodies, but may be integrated in one chip together with other functions, by a custom IC or the like.

The liquid discharging module 20 includes the relay substrate 160 and the aggregate substrate 170 in addition to the above-described four liquid discharging units U in terms of electricity. Among these, the aggregate substrate 170 includes two receiving portions 172, which also function as distribution portions. The two receiving portions 172 correspond to each of the sending portions 102 respectively, for example. One receiving portion 172 inversely converts the multiplexed differential signal to a single end signal, and returns the multiplexed state to an original state (demultiplexing). In other words, one receiving portion 172 separates the digital signal, such as the printing data and the clock signal Sck for two liquid discharging units U, and supplies the signal to the corresponding liquid discharging unit U.

Accordingly, the clock signal Sck and the control signals LAT and CH are supplied together with the corresponding printing data SI(1) to SI(6), SI(7) to SI(12), SI(13) to SI(18), and SI(19) to SI(24) to each of the first, second, third, and fourth liquid discharging units U.

By multiplexing the printing data and the clock signal Sck in this manner, it is possible to reduce the number of wirings of cables which connect the control unit and the aggregate substrate 170 to each other. In addition, by using the printing data and the clock signal Sck as the differential signal, it is possible to transfer the signal at a high frequency that is resistive to noise.

In addition, an L level of the digital signals is 0 V, and an H level is 3.3 V. In addition, in the receiving portion 172, a functional part which inversely converts the received differential signal to the single end digital signal, and a part of a multiplexer which separates the inversely converted digital signal, may be provided as separate bodies.

The driving substrate 150 includes four driving circuits 152. Four driving circuits 152 correspond to each of the liquid discharging units U respectively. One driving circuit 152 includes a voltage generation portion 154, DA converters (DAC) 155 and 156, and amplification circuits (AMP) 157 and 158.

The voltage generation portion 154 generates a signal of the voltage $V_{BS}$ which is commonly applied across the other ends of the plurality of piezoelectric elements Pzt. The DA converter 155 converts the digital data dA to an analog signal, and the amplification circuit 157 amplifies the analog signal by using a class-D amplifier, for example, and outputs the amplified signal as the driving signal COM-A. Similarly, the DA converter 156 converts the data dB to an analog signal, and the amplification circuit 158 amplifies the analog signal and outputs the signal as the driving signal COM-B. Here, for convenience, there is a case where the driving signals COM-A and COM-B, and the signal of the voltage $V_{BS}$ are called the driving signal or the like.

The driving signal or the like output by the driving circuit 152 is supplied to the corresponding liquid discharging unit U via the relay substrate 160.

In addition, since each of the common data dA and dB is supplied to four driving circuits 152, the waveforms of the driving signals COM-A and COM-B output from the four driving circuits 152 are common to each other, but in the example, the waveforms are parallelized for ensuring driving ability.

Figure 16:
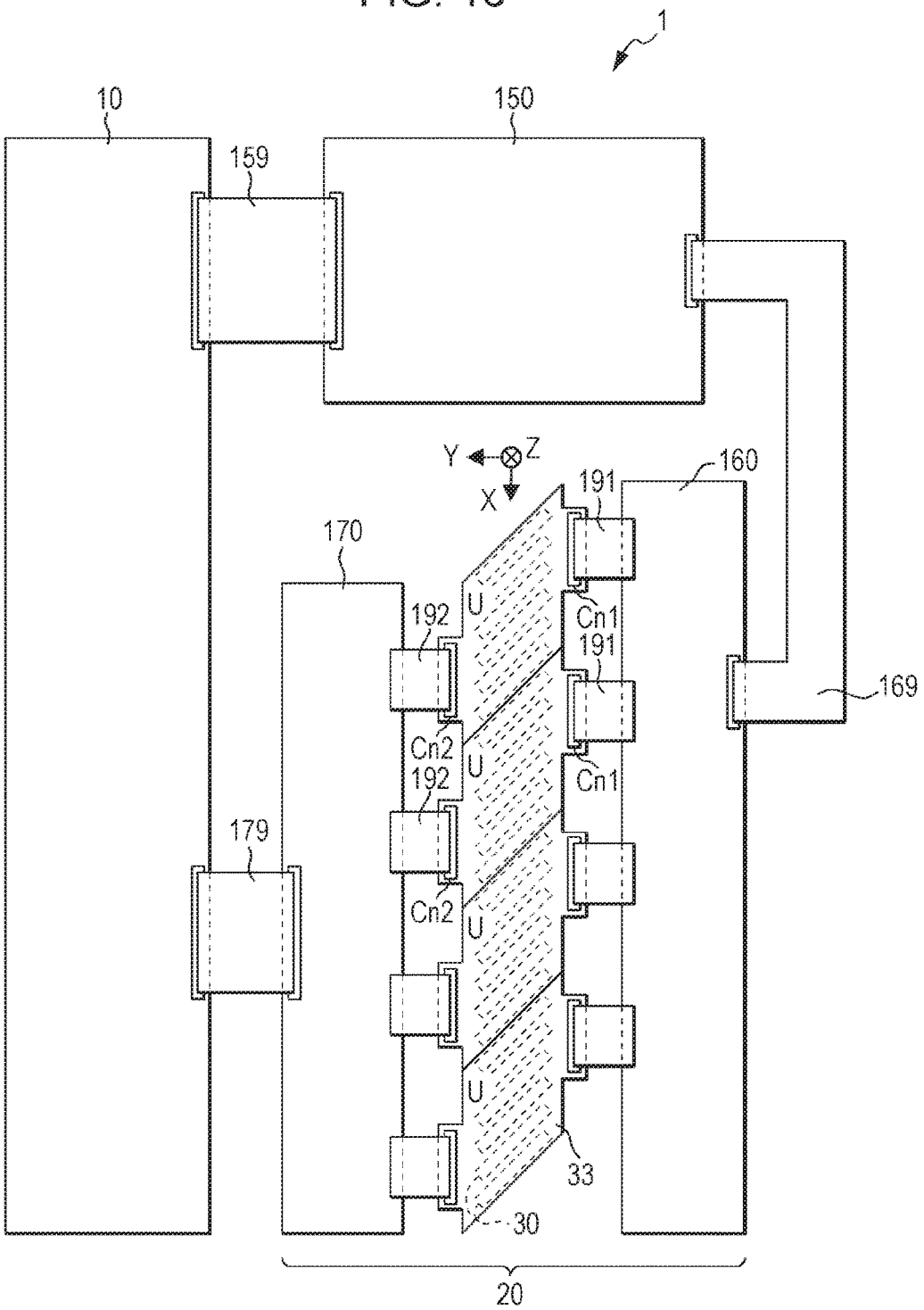
FIG. 16 is a view illustrating connection between substrates in the printing apparatus.

FIG. 16 is a view illustrating the connection between substrates in the printing apparatus 1.

As illustrated in FIG. 16, the relay substrate 160 is positioned on the upstream side in the transporting direction of the printing medium P and the aggregate substrate 170 is positioned on the downstream side in the transporting direction, with respect to the liquid discharging module 20 in which four liquid discharging units U are arranged in the X direction. In other words, the relay substrate 160 is disposed on one side and the aggregate substrate 170 is disposed on the other side so as to nip the liquid discharging head 30.

The control unit 10 supplies the differential signal to the aggregate substrate 170 via the FFC 179 while supplying the data dA and dB to the driving substrate 150 via an FFC 159.

The driving signal or the like output from four driving circuits 152 is supplied to the relay substrate 160 via the FFC 169 from the driving substrate 150.

The relay substrate 160 rearranges the arrangement of four groups of driving signals or the like supplied by the FFC 169 to make the groups of signals correspond to the four liquid discharging units U respectively. In addition, the driving signal or the like rearranged by the relay substrate 160 is supplied to one side of the corresponding liquid discharging unit U via the FFC 191 and the connector Cn1.

In the aggregate substrate 170, the receiving portion 172 receives the differential signal, inversely converts the signal to the single end signal, and separates the printing data and the clock signal Sck for two liquid discharging units U. The separated printing data and the clock signal Sck are supplied to the other end of the corresponding liquid discharging unit U via the FFC 192 and the connector Cn2.

In this manner, the analog driving signal or the like is supplied from one side, and the printing data and the clock signal Sck are supplied from the other side so as to nip the arrangement of the liquid discharging head 30.

Figure 17:
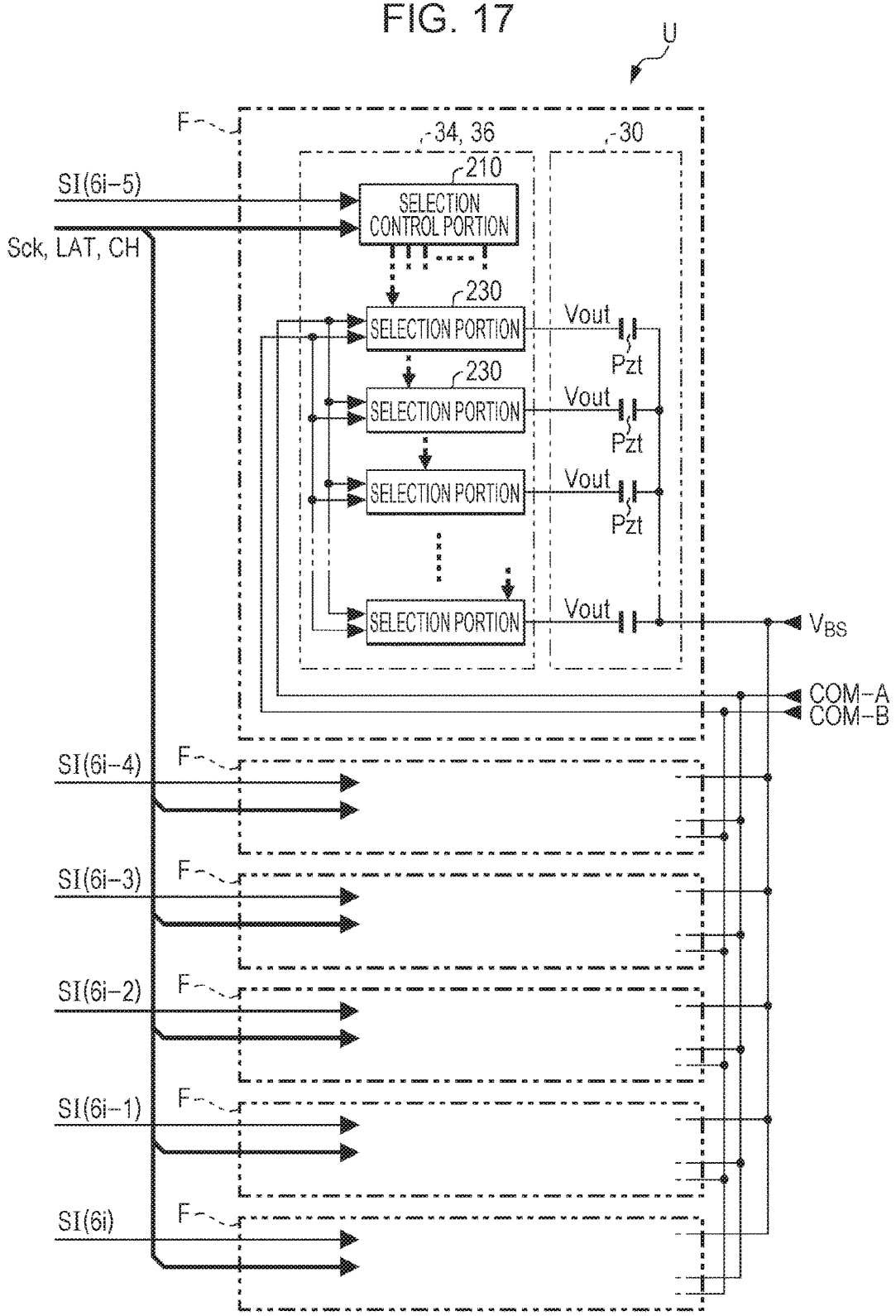
FIG. 17 is a block diagram illustrating a functional configuration in the liquid discharging unit.

FIG. 17 is a diagram illustrating an electrical configuration in the liquid discharging unit U. In addition, since the configurations of the first to the fourth liquid discharging units U are the same as each other, here, for convenience, i-th (i is any of integers from 1 to 4) liquid discharging unit U will be described.

As described above, the liquid discharging unit U is configured of six head blocks F in terms of electricity, and one head block F is configured of the wiring substrate 34, the semiconductor chip 36, and the liquid discharging head 30.

The semiconductor chip 36 mounted on the wiring substrate 34 of the head block F functionally includes a selection control portion 210 and a plurality of selection portions 230 which make a pair with the nozzle N. Meanwhile, the liquid discharging head 30 is configured of a plurality (in the examples of FIG. 3 or the like, 26 elements×2 rows =52 elements) of piezoelectric elements Pzt in terms of electricity.

In one liquid discharging unit U, the configurations of six head blocks F are the same as each other, and i-th liquid discharging unit U is configured of six liquid discharging heads 30, such as (6i−5)-th, (6i−4)-th, (6i−3)-th, (6i−2)-th, (6i−1)-th, and (6i)-th liquid discharging heads 30. The clock signal Sck or the like is supplied to the selection control portion 210 corresponding to the liquid discharging heads 30 in order in addition to printing data SI(6i−5), SI(6i−4), SI(6i−3), SI(6i−2), SI(6i−1), and SI(6i).

Since the configurations of the head blocks F are the same as each other, here, for convenience, the head block F which includes (6i−5)-th liquid discharging head 30 will be described.

In the head block F, the selection control portion 210 distributes the printing data SI(6i−5) corresponding to each of the piezoelectric elements Pzt, and the selection portion 230 selects (or select none of the signals) the driving signals COM-A and COM-B in accordance with the distributed printing data and supplies the selected signal to the driving electrode 72 (refer to FIG. 5) which is one end of the piezoelectric element Pzt.

In addition, in FIG. 17, for distinguishing the driving signals COM-A and COM-B, a voltage of the driving signal selected by the selection portion 230 is written as Vout.

The voltage $V_{BS}$ is commonly applied to the other end in each of the piezoelectric elements Pzt as described above.

In the embodiment, regarding one dot, by discharging the ink from one nozzle N a maximum of two times, four gradations, such as a large dot, an intermediate dot, a small dot, and non-recording, are expressed. In order to express the four gradations, in the embodiment, two types of driving signals COM-A and COM-B are prepared, and each of the driving signals has a first-half pattern and a second-half pattern in one cycle. In addition, in one cycle, the driving signals COM-A and COM-B in the first-half pattern and the second-half pattern are selected corresponding to the gradation to be expressed (or not selected), and supplied to the piezoelectric element Pzt.

Here, first, the driving signals COM-A and COM-B will be described, and then, a configuration for selecting the driving signals COM-A and COM-B will be described.

Figure 18:
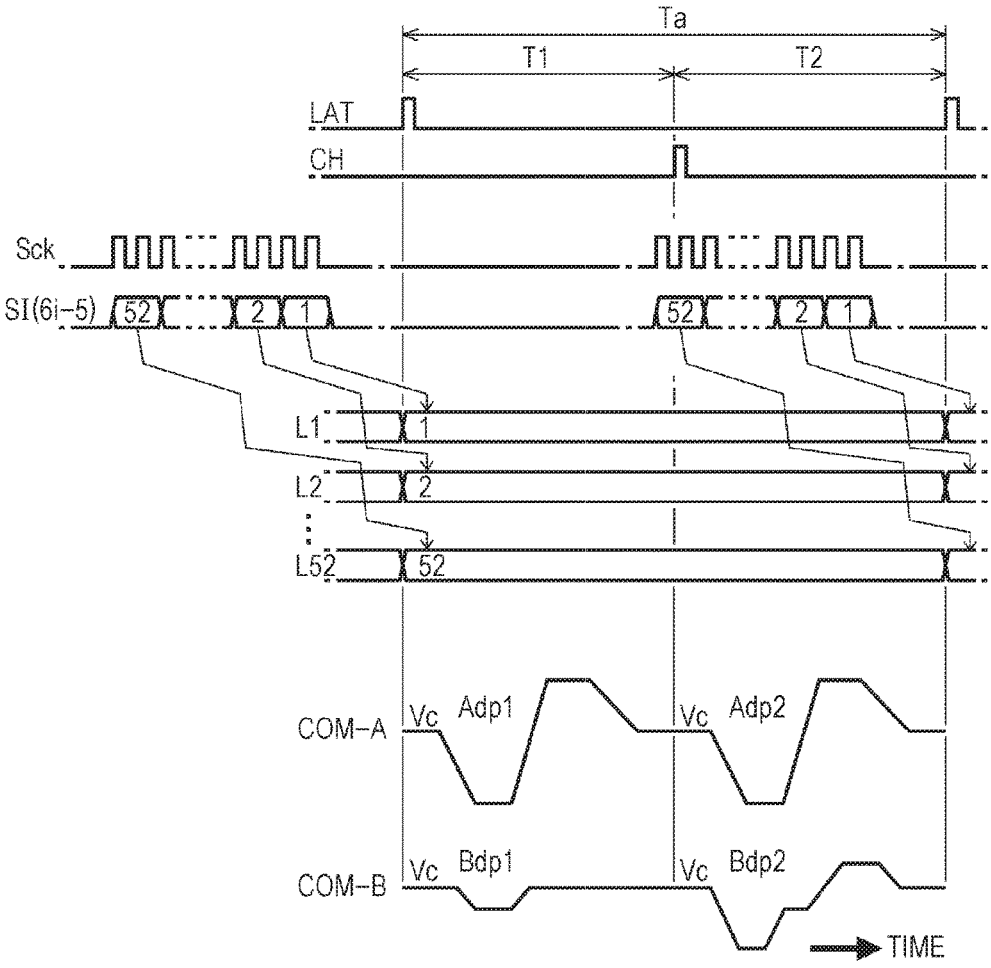
FIG. 18 is a view illustrating an operation of a selection control portion.

FIG. 18 is a view illustrating waveforms or the like of the driving signals COM-A and COM-B.

As illustrated in FIG. 18, the driving signal COM-A is a waveform in which a trapezoidal waveform Adp1 which is in a period T1 from the output (rising) of the control signal LAT to the output of the control signal CH in a printing cycle Ta, and a trapezoidal waveform Adp2 which is in a period T2 from the output of the control signal CH to the output of the following control signal LAT in the printing cycle Ta, repeat.

The trapezoidal waveforms Adp1 and Adp2 in the embodiment have substantially the same shape as each other, and if each of the trapezoidal waveforms is supplied to one end of the piezoelectric elements Pzt, each of the trapezoidal waveforms discharges a predetermined amount, specifically, an approximately intermediate amount of ink from the nozzle N corresponding to the piezoelectric element Pzt.

The driving signal COM-B is a waveform in which a trapezoidal waveform Bdp1 in the period T1 and a trapezoidal waveform Bdp2 in the period T2 repeat. The trapezoidal waveforms Bdp1 and Bdp2 in the embodiment are waveforms different from each other. Among these, the trapezoidal waveform Bdp1 is a waveform for preventing the viscosity of the ink from increasing by micro-vibrating the ink in the vicinity of an opening hole portion of the nozzle N. For this reason, even if the trapezoidal waveform Bdp1 is supplied to one end of the piezoelectric element Pzt, the ink droplets are not discharged from the nozzle N corresponding to the piezoelectric element Pzt. In addition, the trapezoidal waveform Bdp2 is a waveform different from the trapezoidal waveform Adp1 (Adp2). If the trapezoidal waveform Bdp2 is supplied to one end of the piezoelectric element Pzt, the trapezoidal waveform Bdp2 discharges a smaller amount of ink than the predetermined amount from the nozzle N corresponding to the piezoelectric element Pzt.

In addition, any of a voltage at an initiation timing of the trapezoidal waveforms Adp1, Adp2, Bdp1, and Bdp2, and a voltage at a termination timing, is a common voltage Vc. In other words, each of the trapezoidal waveforms Adp1, Adp2, Bdp1, and Bdp2 is a waveform which is initiated at the voltage Vc and terminated at the voltage Vc.

In addition, the maximum voltage of the trapezoidal waveform Adp1 is approximately 42 V.

Figure 19:
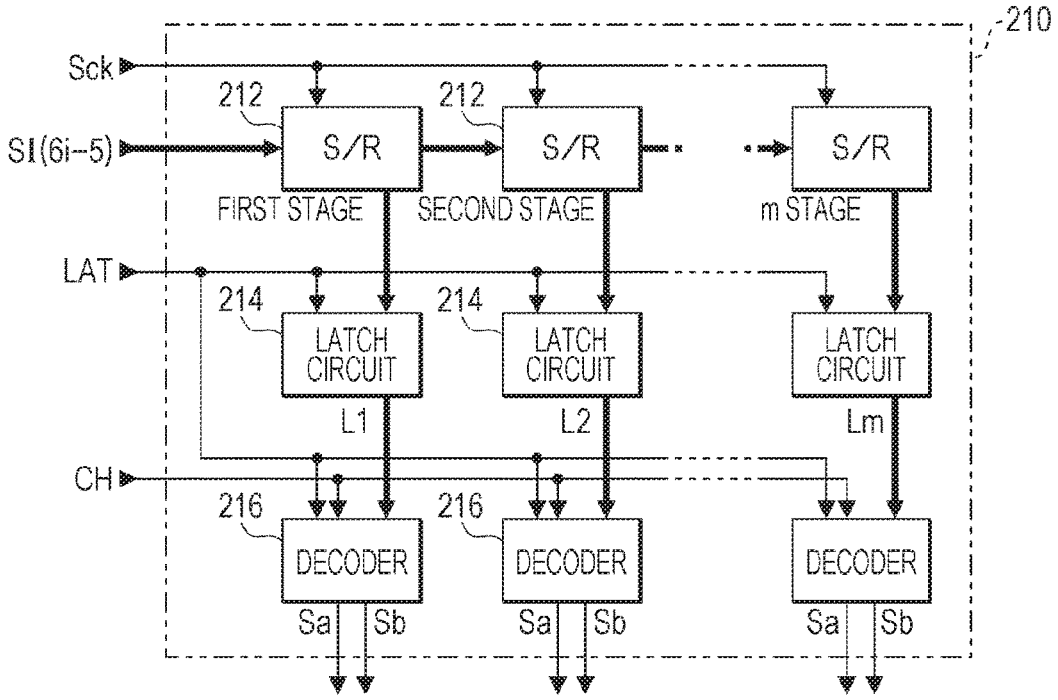
FIG. 19 is a view illustrating the configuration of the selection control portion.

FIG. 19 is a view illustrating a configuration of the selection control portion 210 in FIG. 17.

As illustrated in FIG. 19, the clock signal Sck, the printing data SI(6i−5), and the control signals LAT and CH are supplied to the selection control portion 210. In the selection control portion 210, a group of a shift register (S/R) 212, a latch circuit 214, and a decoder 216 is provided corresponding to each of the piezoelectric elements Pzt (nozzles N).

The printing data SI(6i−5) is data which regulates a dot to be formed by all (52) of the nozzles N of the (6i−5)-th liquid discharging head 30 in the printing cycle Ta. In the embodiment, in order to express four gradations, such as non-recording, a small dot, an intermediate dot, and a large dot, the printing data for one nozzle is configured of 2 bits including a high-order bit (MSB) and a low-order bit (LSB).

The printing data SI(6i−5) is synchronized with the clock signal Sck, and is supplied matching the transporting of the printing medium P in every nozzle N (piezoelectric element Pzt). A configuration for holding the printing data SI(6i−5) by 2 bits corresponding to the nozzle N is the shift register 212.

Specifically, the shift registers 212 in which the number of stages corresponds to the piezoelectric elements Pzt (nozzles) are continuously connected to each other, and the printing data SI which is supplied to the first stage of the shift register 212 positioned at a left end in the drawing is transferred to the following stage in accordance with the clock signal Sck.

In addition, in the embodiment, the number of the piezoelectric elements Pzt (nozzles) is "52". Here, in order to distinguish the shift registers 212, a first stage, a second stage, . . . , the 52-nd stage are written in order from an upstream side in which the data SI(6i−5) is supplied.

The latch circuit 214 latches the printing data SI held by the shift register 212 at the rise of the control signal LAT. In addition, since the printing data held by the shift register 212 is not the printing data SI(6i−5) which illustrates 52 nozzles, but one nozzle, the reference numeral is simply SI in order to avoid confusion.

The decoder 216 decodes the 2-bit printing data SI which is latched by the latch circuit 214, outputs selected signals Sa and Sb in each of the periods T1 and T2 regulated by the control signal LAT and the control signal CH, and regulates the selection by the selection portion 230.

Figures 20, 21:
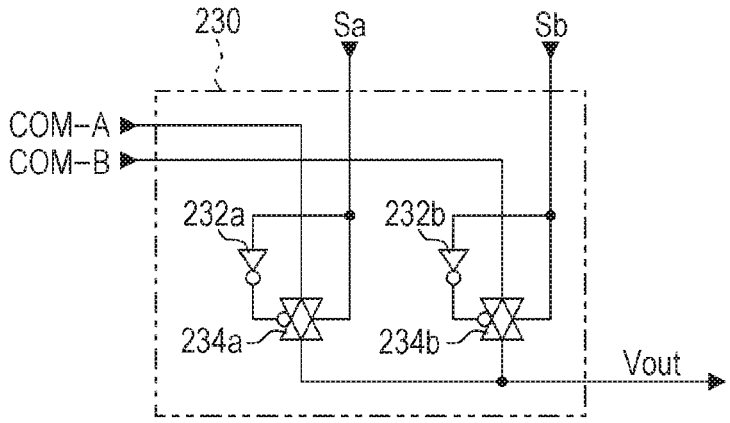
FIG. 20 is a view illustrating decoding contents of a decoder.
FIG. 21 is a view illustrating a configuration of a selection portion.

FIG. 20 is a view illustrating decoding contents in the decoder 216.

In FIG. 20, the latched 2-bit printing data SI is written as (MSB, LSB). A case where the latched printing data SI is (0, 1), for example, means that the decoder 216 performs the output by setting each of logic levels of the selected signals Sa and Sb to be at H and L levels in the period T1, and to be at L and H levels in the period T2.

In addition, the logic levels of the selected signals Sa and Sb are level-shifted to a high amplitude logic by a level shifter (not illustrated) from the logic levels of the clock signal Sck, the printing data SI, and the control signals LAT and CH.

FIG. 21 is a view illustrating a configuration of the selection portion 230 in FIG. 17.

As illustrated in FIG. 21, the selection portion 230 includes inverters (NOT circuits) 232*a* and 232*b*, and transfer gates 234*a* and 234*b*.

While the selected signal Sa from the decoder 216 is supplied to a positive control end to which a circle is not attached in the transfer gate 234*a*, the selected signal Sa is logic-inverted by the inverter 232*a*, and supplied to a negative control end to which a circle is attached in the transfer gate 234*a*. Similarly, while the selected signal Sb is supplied to a positive control end of the transfer gate 234*b*, the selected signal Sb is logic-inverted by the inverter 232*b*, and supplied to a negative control end of the transfer gate 234*b*.

The driving signal COM-A is supplied to an input end of the transfer gate 234*a*, and the driving signal COM-B is supplied to an input end of the transfer gate 234*b*. Output ends of the transfer gates 234*a* and 234*b* are commonly connected to each other, and are connected to one end of the corresponding piezoelectric element Pzt.

If the selected signal Sa is at the H level, the transfer gate 234*a* is conducted (ON) between the input end and the output end, and if the selected signal Sa is at the L level, the transfer gate 234*a* is non-conducted (OFF) between the input end and the output end. Similarly, the transfer gate 234*b* is turned ON and OFF between the input end and the output end corresponding to the selected signal Sb.

As illustrated in FIG. 18, the printing data SI(6i−5) is synchronized with the clock signal Sck and supplied in descending order of the nozzle number of every nozzle, and is transferred in order in the shift register 212 corresponding to the nozzle. In addition, when the supply of the clock signal Sck is stopped, the printing data SI which corresponds to the nozzle number is held in each of the shift registers 212.

Here, when the control signal LAT rises, each of the latch circuits 214 simultaneously latches the printing data SI held in the shift register 212. In FIG. 18, the numbers in L1, L2, . . . , L52 illustrate the nozzle numbers of the printing data SI which is latched by the latch circuit 214 corresponding to the shift register 212 on the first stage, the second stage, . . . , the 52-nd stage.

The decoder 216 outputs the logic levels of the selected signals Sa and Sb as the contents illustrated in FIG. 20 in each of the periods T1 and T2 in accordance with the size of the dots regulated by the latched printing data SI.

In other words, firstly, when the printing data SI is (1, 1) and regulates the size of the large dot, the decoder 216 sets the selected signals Sa and Sb to the H and L levels in the period T1, and to the H and L levels even in the period T2. Secondly, when the printing data SI is (0, 1) and regulates the size of the intermediate dot, the decoder 216 sets the selected signals Sa and Sb to the H and L levels in the period T1, and to the L and H levels in the period T2. Thirdly, when the printing data SI is (1, 0) and regulates the size of the small dot, the decoder 216 sets the selected signals Sa and Sb to the L and L levels in the period T1, and to the L and H levels in the period T2. Fourthly, when the printing data SI is (0, 0) and regulates non-recording, the decoder 216 sets the selected signals Sa and Sb to the L and H levels in the period T1, and to the L and L levels in the period T2.

Figure 22:
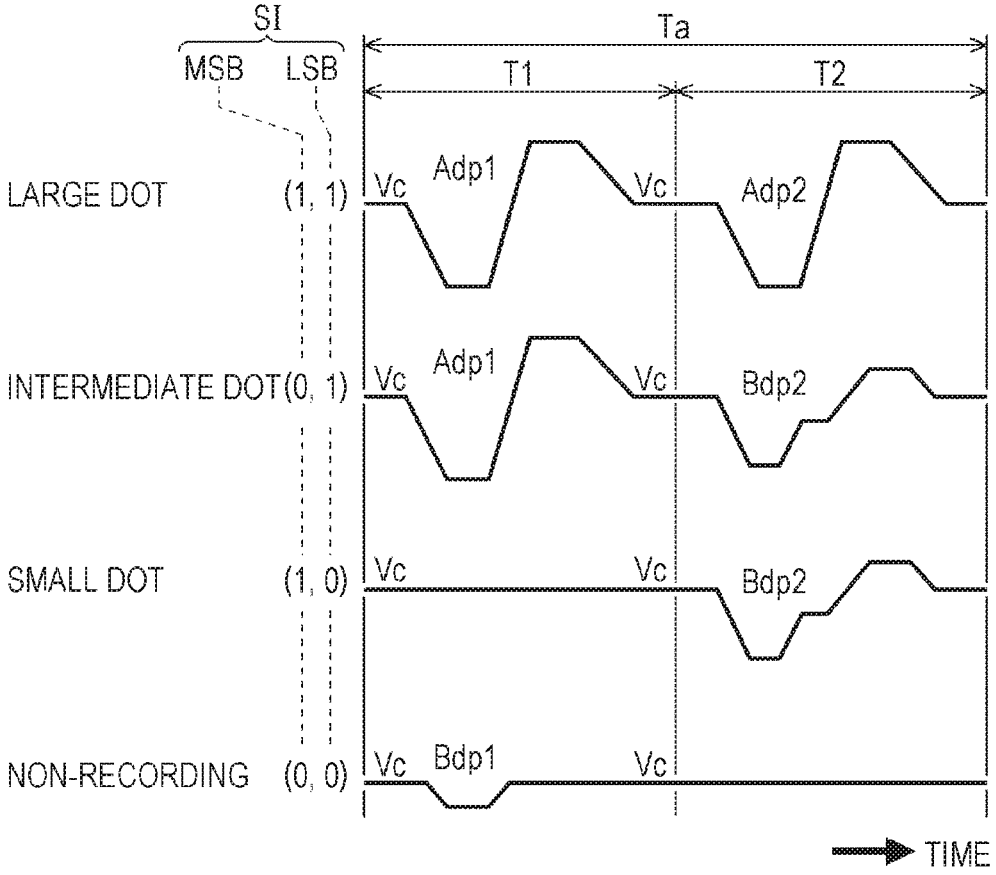
FIG. 22 is a view illustrating a waveform example of a driving signal supplied to one end of a piezoelectric element.

FIG. 22 is a view illustrating a piezoelectric waveform of the driving signal selected in accordance with the printing data SI and supplied to one end of the piezoelectric element Pzt.

When the printing data SI is (1, 1), since the selected signals Sa and Sb become the H and L levels in the period T1, the transfer gate 234*a* becomes ON and the transfer gate 234*b* becomes OFF. For this reason, the trapezoidal waveform Adp1 of the driving signal COM-A is selected in the period T1. Since the selected signals Sa and Sb become the H and L levels even in the period T2, the selection portion 230 selects the trapezoidal waveform Adp2 of the driving signal COM-A.

In this manner, when the trapezoidal waveform Adp1 is selected in the period T1, the trapezoidal waveform Adp2 is selected in the period T2, and the waveforms are supplied to one end of the piezoelectric element Pzt as the driving signal, an approximately intermediate amount of ink is discharged two separate times from the nozzle N which corresponds to the piezoelectric element Pzt. For this reason, each drop of ink lands and is integrated as one drop on the printing medium P, and consequentially, the large dot according to the regulation of the printing data SI is formed.

When the printing data SI is (0, 1), since the selected signals Sa and Sb become the H and L levels in the period T1, the transfer gate 234*a* becomes ON and the transfer gate 234*b* becomes OFF. For this reason, the trapezoidal waveform Adp1 of the driving signal COM-A is selected in the period T1. Then, since the selected signals Sa and Sb become the L and H levels in the period T2, the trapezoidal waveform Bdp2 of the driving signal COM-B is selected.

Therefore, an intermediate amount and a small amount of ink are discharged two separate times from the nozzle. For this reason, each drop of ink lands and is integrated as one drop on the printing medium P, and consequentially, the intermediate dot according to the regulation of the printing data SI is formed.

When the printing data SI is (1, 0), since the selected signals Sa and Sb become the L level in the period T1, the transfer gates 234*a* and 234*b* become OFF. For this reason, neither of the trapezoidal waveforms Adp1 or Bdp1 is selected in the period T1. When both the transfer gates 234*a* and 234*b* are OFF, a route from a connection point between the output ends of the transfer gates 234*a* and 234*b* to one end of the piezoelectric element Pzt becomes a high impedance state of not being electrically connected to any part. However, a voltage ($Vc-V_{BS}$) immediately before the transfer gate becomes OFF is maintained at both ends of the piezoelectric element Pzt due to capacitive characteristics thereof.

Next, since the selected signals Sa and Sb become the L and H levels in the period T2, the trapezoidal waveform Bdp2 of the driving signal COM-B is selected. For this reason, since an approximately small amount of ink is discharged from the nozzle N only in the period T2, the small dot according to the regulation of the printing data SI is formed on the printing medium P.

When the printing data SI is (0, 0), since the selected signals Sa and Sb become the L and H levels in the period T1, the transfer gate 234*a* becomes OFF and the transfer gate 234*b* becomes ON. For this reason, the trapezoidal waveform Bdp1 of the driving signal COM-B is selected in the period T1. Then, since both the selected signals Sa and Sb become the L level in the period T2, neither of the trapezoidal waveforms Adp2 or Bdp2 is selected.

For this reason, since the ink in the vicinity of the opening hole portion of the nozzle N only micro-vibrates in the period T1 and the ink is not discharged, consequentially, the dot is not formed, that is, non-recording according to the regulation of the printing data SI is performed.

In this manner, the selection portion 230 selects (or does not select) the driving signals COM-A and COM-B following an instruction by the selection control portion 210, and supplies the driving signals to one end of the piezoelectric element Pzt. For this reason, each piezoelectric element Pzt is driven in accordance with the size of the dots regulated by the printing data SI.

In addition, the driving signals COM-A and COM-B illustrated in FIG. 18 are merely examples. In reality, in accordance with characteristics or a moving speed of the printing medium P, combination of various waveforms prepared in advance is used.

In addition, here, the piezoelectric element Pzt is described in an example in which the piezoelectric element Pzt bends upwardly according to the falling of the voltage, but when the voltage applied to the electrodes 72 and 76 is reversed, the piezoelectric element Pzt bends upwardly according to the rise of the voltage. For this reason, in a configuration in which the piezoelectric element Pzt bends upwardly according to the rise of the voltage, the driving signals COM-A and COM-B illustrated in FIG. 18 become waveforms reversed in accordance with the voltage Vc.

What is claimed is:

1. A liquid discharging apparatus comprising:

a first cover having first, second, and third plates, the third plate having first and second through holes therein, the third plate extending along a first direction, the first and second plates extending along a second direction perpendicular to the first direction, the third plate connecting between edges of the first and second plates in the first direction;

a discharging member having a nozzle and first and second connectors, the nozzle discharging liquid, the first connector being spaced apart from the second connector in the first direction, the first and second connectors being provided between the first and second plates in the first direction and provided between the third plate and the nozzle in the second direction;

a first cable that passes through the first through hole so as to be connected to the first connector;

a second cable that passes through the second through hole so as to be connected to the second connector; and a first substrate that is connected to the first cable, wherein the third plate is located between the first substrate and the discharging member in the second direction.

2. The liquid discharging apparatus according to claim 1, wherein the first connector is configured with a plurality of first connectors, and the plurality of first connectors are provided at the discharging member at a predetermined interval from one another.

3. The liquid discharging apparatus according to claim 1, further comprising:

a second substrate that is connected to the second cable, wherein the third plate is located between the second substrate and the discharging member in the second direction.

4. The liquid discharging apparatus according to claim 3, wherein the second connector is configured with a plurality of second connectors, and the second cable is configured with a plurality of second cables, the plurality of second connectors are connected to the second substrate via the plurality of second cables, and the plurality of second connectors are provided at the discharging member at a predetermined interval from one another.

5. The liquid discharging apparatus according to claim 4, wherein when a signal having a frequency f is supplied to the second substrate, one of the plurality of second connectors receives the signal via one of the plurality of second cable, and the predetermined interval is shorter than a value of c/f, wherein the c is velocity of light.

6. The liquid discharging apparatus according to claim 3, wherein the first substrate receives a first signal, and the second substrate receives a second signal, and the first signal is different from the second signal.

7. The liquid discharging apparatus according to claim 6, wherein a voltage value of the first signal is higher than a voltage value of the second signal.

8. The liquid discharging apparatus according to claim 6, wherein a frequency of the second signal is higher than a frequency of the first signal.

9. The liquid discharging apparatus according to claim 6, wherein the first signal includes a driving signal, and the second signal includes a clock signal.

10. The liquid discharging apparatus according to claim 1, wherein the first connector is configured with a plurality of first connectors, and the plurality of first connectors are connected to the first substrate.

11. A liquid discharging apparatus comprising:

a first cover having first, second, and third plates, the third plate having first and second through holes therein, the third plate extending along first direction, the first and second plates extending along a second direction perpendicular to the first direction, the third plate connecting between edges of the first and second plates in the first direction;

a discharging member having a nozzle and first and second connectors, the nozzle discharging liquid, the first connector being spaced apart from the second connector in the first direction, the first and second connectors being provided between the first and second plates in the first direction and provided between the third plate and the nozzle in the second direction;

a first cable that passes through the first through hole so as to be connected to the first connector;

a second cable that passes through the second through hole so as to be connected to the second connector;

a first substrate that is connected to the first cable;

a second substrate that is connected to the second cable; and a second cover having fourth, fifth, and sixth plates, the sixth plate extending along the first direction, the fourth and fifth plates extending along the second direction, the sixth plate connecting between edges of the fourth and fifth plates in the first direction, the second cover being provided on the first cover so that other edges of the fourth and fifth plates are connected to the edges of the first and second plates of the first cover, respectively, wherein the third plate of the first cover is provided between the discharging member and the first and second substrates in the second direction, the first and second substrates are provided between the fourth plate and the fifth plate in the first direction, and the first and second substrates are provided between the sixth plate and the third plate in the second direction so that the first and second substrates are enclosed by the second cover and the third plate of the first cover.

12. The liquid discharging apparatus according to claim 11, further comprising:

a third cable that is connected to the first substrate, the third cable passing through a third through hole provided in the sixth plate of the second cover.

13. The liquid discharging apparatus according to claim 12, further comprising:

a fourth cable that is connected to the second substrate, the fourth cable passing through a fourth through hole provided in the sixth plate of the second cover.

14. The liquid discharging apparatus according to claim 11, further comprising:

a first connecting member that is fixed between the edge of the first plate of the first cover and the other edge of the fourth plate of the second cover.

15. The liquid discharging apparatus according to claim 14, wherein the fourth plate is provided between the first connecting member and the first substrate in the second direction.

16. The liquid discharging apparatus according to claim 11, further comprising:

a second connecting member that is fixed between the edge of the second plate of the first cover and the other edge of the fifth plate of the second cover.

17. The liquid discharging apparatus according to claim 16, wherein the fifth plate is provided between the second connecting member and the second substrate.

* * * * *